United States Patent [19]

Dean et al.

[11] Patent Number: 4,601,380

[45] Date of Patent: Jul. 22, 1986

[54] APPARATUS FOR CHECKING THE VALIDITY OF COINS

[75] Inventors: Robert Dean, Farnham Common; Peter J. Reyner, Northwood; Derek Hutchinson, Hillingdon, all of England

[73] Assignee: Mars Incorporated, McLean, Va.

[21] Appl. No.: 425,072

[22] PCT Filed: Feb. 11, 1982

[86] PCT No.: PCT/GB82/00033

§ 371 Date: Sep. 10, 1982

§ 102(e) Date: Sep. 10, 1982

[87] PCT Pub. No.: WO82/02786

PCT Pub. Date: Aug. 19, 1982

[30] Foreign Application Priority Data

Feb. 11, 1981 [GB] United Kingdom ..... 8104175
Dec. 10, 1981 [GB] United Kingdom ..... 8137250

[51] Int. Cl.[4] ..... G07D 5/08
[52] U.S. Cl. ..... 194/318
[58] Field of Search ..... 194/99, 100 R, 100 A

[56] References Cited

U.S. PATENT DOCUMENTS

| | | | |
|---|---|---|---|
| 3,599,771 | 8/1971 | Hinterstocker | 194/100 a |
| 3,738,469 | 6/1973 | Prumm | 194/101 |
| 3,918,565 | 11/1975 | Fougere | 194/100 A |
| 3,952,851 | 4/1976 | Fougere et al. | 194/100 A |

FOREIGN PATENT DOCUMENTS

| | | |
|---|---|---|
| 2825770 | 1/1980 | Fed. Rep. of Germany . |
| WO80/00505 | 3/1980 | World Int. Prop. O. . |
| 74/6145 | 9/1975 | South Africa . |
| 1255492 | 12/1971 | United Kingdom . |
| 1272560 | 5/1972 | United Kingdom . |
| 1483192 | 8/1977 | United Kingdom . |
| 2045500 | 10/1980 | United Kingdom . |

*Primary Examiner*—F. J. Bartuska
*Attorney, Agent, or Firm*—Davis Hoxie Faithfull & Hapgood

[57] ABSTRACT

Apparatus for checking the validity of coins, the apparatus requiring electrical power for its coin checking operation, and comprising a coin path, and at least one sensor (HF1,LF,HF2) for interacting with a coin on the coin path to provide an information signal, characterized by one of said interacting sensors (HF1) providing an information signal in response to at least the great majority of coin types, a circuit (316,315) for determining whether the information signals are indicative of an acceptable coin, and a detector (316) operable by the occurrence of the information signal from said one interacting sensor to initiate the application within the apparatus of power adequate for its coin checking operation, the detector being adapted to so operate irrespective of whether or not the information signal from said one interacting sensor is indicative of an acceptable coin, whereby said power application occurs substantially every time a coin passes along the coin path.

32 Claims, 16 Drawing Figures

BIAS CCT
311
LF OSC.
302
I
AMP.
312
RECT. CCT
313
450
V/F
314
310
407
471
400
HF2 OSC.
301
HF1 OSC.
300
308
309
317
318
319
y
501
502
c
b
a
LSI
316
PROM
315
A
402
B
POWER
304
306
305
500
307
402

315
316
A0
A1
A2
A3
A4
A5
A6
J K L M N P Q
C D E
A B
HF1
HF2

FIG.6
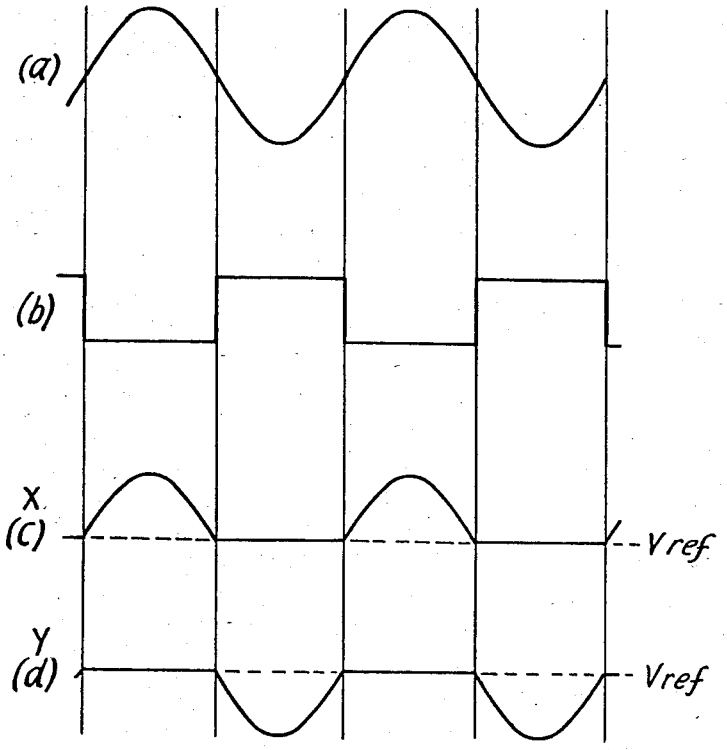
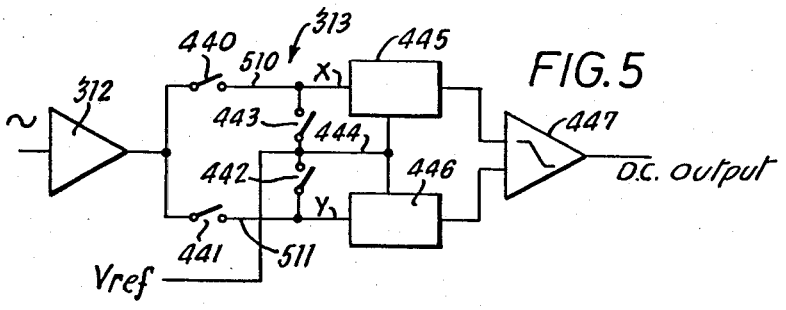
FIG.5

BIAS CCT
311
LF OSC.
302
I
AMP
312
RECT. CCT
313
450
V/F
314
310
407
1001
V/R
1000
1005
400
471
1006
308
309
317
318
319
301
HF2 OSC.
300
HF1 OSC.
501
502
c
b
a
LSI
316
PROM
315
y
A
402
B
306'
POWER
304

APPARATUS FOR CHECKING THE VALIDITY OF COINS

FIELD OF THE INVENTION

This invention relates to improvements in and relating to apparatus for checking the validity of coins.

Throughout the specification the term "coin" is intended to mean genuine coins, tokens, counterfeit coins, slugs, washers and any other item which may be used by persons in an attempt to use coin-operated devices.

BACKGROUND OF THE INVENTION

At the present time, various kinds of electronic coin validity-checking apparatus are in common use, for example employing one or more inductive sensing coils or transmit/receive coils at different positions spaced along a coin track along which a coin, inserted into the apparatus, travels. The sensing coils are connected to electronic processing circuitry in which the magnitude of a signal characteristic (i.e. frequency, amplitude or phase), which varies in dependence upon characteristics of the coin as the coin moves past the or each inductive sensor, is compared with predetermined values which are indicative of acceptable coins of one or more particular denominations. In this way, the validity of the test coin can be checked, and the coin rejected if it does not pass the appropriate tests.

The electronic circuitry when switched on is generally permanently energised from a power source. In many applications, continuous power consumption is unimportant. For example, when the validation circuitry is used in combination with a vending machine for dispensing hot drinks, the proportion of the average power consumed by the processing circuitry is negligible as compared with that required by the heater and control equipment in the vending machine. However, in certain uses of coin validity-checking apparatus such as in pay telephones which are supplied from relatively low power supplies or cigarette vending machines or parking meters supplied from batteries, the average power consumed by validation circuitry of the kind described is unacceptably high. In pay telephones in use in many countries throughout the world, various forms of mechanical coin validity-checking apparatus are still adopted at the present time and whilst it would be desirable to replace these mechanical systems with electronic apparatus to improve the integrity of the validation checks carried out on inserted coins, known electronic coin validity-checking apparatus are generally unable to comply with the requirement for the very low average power consumption (e.g. 2 mA at 5 volts).

In our British Pat. No. 1,483,192, there is disclosed electronic coin validity-checking apparatus which comprises a transmitter/receiver inductive arrival sensor operative to produce an output signal when an inserted coin passing between the coils along a coin passage is of an acceptable material. At a position further downstream the coin passage, the coin is optically tested to check its velocity, diameter etc. as disclosed in our U.K. Patent Specification No. 1,272,560, and if the coin passes both the initial inductive and subsequent optical tests, the coin is accepted through an acceptable gate into an acceptance passageway. The optical test involves the use of light sources with associated optical coin sensors such as photoelectric devices. If these optical sources are permanently energised, they have a particular expected life. Therefore, to extend the expected life of these sources, the light sources are switched on by the output signal from the inductive arrival sensor. The trend in recent years has been towards inductive and capacitive techniques for carrying out the desired measurements of coin characteristics in the examination region, but as mentioned above the total power consumption in known coin handling mechanisms is unacceptably high for certain applications.

In U.S. Pat. No. 3,738,469, various forms of apparatus are disclosed for examining coins in which each coin is firstly checked for size by a sensing switch of one form or another, and then a second test is performed by a measuring probe. The coin is accepted only if it passes both tests. The apparatus is continuously supplied with power but this is disadvantageous where the apparatus is dependent upon battery power. In order to reduce the power consumption, it is possible to utilise the diameter sensitive switch to switch-in and switch-out the current supply network. However, the switch is operated by the coin before the coin arrives in the examination region of the measuring probe so that, despite the measures taken, the current supply network is switched in slightly prematurely. Also, the diameter sensitive switch is set to be operated by contact of the coin edge as the coin passes the switch, whereas at the present time contactless measurements are to be preferred for several reasons including reliability. In addition, the switch arranged at a particular spacing from the coin track can detect coins of one size only and therefore is not suitable for multi-denomination use where only a single coin track is employed.

SUMMARY OF THE INVENTION

One aim of the present invention is to provide improved coin handling apparatus which performs the necessary measurements on the coin inductively or capacitively, but whose average power consumption is relatively low.

According to the invention from a first aspect, there is provided apparatus for checking the validity of coins, comprising means arranged to establish a changing magnetic or electric field in an examination region, and circuit means for determining whether the degree of interaction between a coin, when in the examination region, and the field is indicative of an acceptable coin, the circuit means being capable of being switched on in blocks in accordance with a program so as to reduce the average power consumption of the circuit means, and there being detector means arranged to initiate said program only upon detecting the presence of a coin to be tested.

Essentially, therefore, the coin validity-checking apparatus draws only low mean power, power consumption being kept to a minimum when the design of each section of the validation circuitry is optimised for minimum power consumption when energised and, in addition, circuit blocks are switched so as to become operative substantially only for sufficient time to perform the tasks assigned to them. As a result, when awaiting the arrival of a coin, the standby power consumption is either zero or very low and even when a coin is in the examination region, the power consumption is kept to a minimum. Therefore, overall, the average power consumption is also very low.

According to the invention from a second aspect, there is provided apparatus for checking the validity of coins, comprising means arranged to establish a changing magnetic or electric field in an examination region, and circuit means for determining whether the degree of interaction between a coin, when in the examination region, and the field is indicative of an acceptable coin, the circuit means being capable of being powered up and there being detector means operative to detect arrival of a coin in said examination region so as to power up the circuit means only for a limited duration in which the circuit means effects the aforesaid determination of coin acceptability.

Because the circuit means is not powered up until the coin arrives in the examination region of the fieldestablishing means, reduced mean power consumption is achieved for the coin validity checking apparatus.

The powering-up of the circuit means can involve switching on the circuit means or increasing the power supplied and can take place in blocks or the entire circuitry can be powered up at the same time.

In the case of both the first and second aspects of the invention, the circuit means, in one embodiment, comprises memory means for storing upper and lower limit values representative of a range of degrees of interaction between the field and any coin which is to be acceptable, means arranged to determine the degree of interaction between the field and a coin in the examination region, and comparator means arranged to determine whether the detected degree of interaction lies within said range. There are currently available low-cost memories which are volatile (i.e. the stored information is destroyed if the applied power is removed). Therefore, such memories would need to be permanently energised. Non-volatile memories tend to consume larger quantities of power. However, in a preferred arrangement, the memory means is rendered operative substantially only for sufficient time to enable the stored limit values to be read out. By using, currently available, low-cost, non-volatile memories in this way, it is found that the mean power consumption can be kept very low.

In another arrangement the circuit means includes an inductive sensing device which is positioned alongside the coin path so that in addition to establishing the changing field in the examination region, it serves for sensing the degree of interaction between the coin and the field, and for determining arrival of the coin in the examination region by detecting the aforesaid degree of interaction attaining a predetermined threshold which is set to be passed through by any acceptable coin while travelling through the examination region.

By employing a single sensing device to serve both to detect coin arrival and also to check the validity of the coin, the need for separate sensing devices for performing these two tasks is avoided.

The sensing device may be connected in an oscillating circuit whose frequency of oscillation reaches a maximum value during the passage of the coin past the sensing device.

The peak frequency is a measure of one or more characteristics of the coin and can be processed for determining whether the coin complies with predetermined criteria of acceptability. Even though it is the peak frequency which is used in the measurement, the interaction between the coin and the magnetic field set up by the inductive sensor also has the effect of reducing the amplitude of the oscillator output signal. In a convenient method of measuring the oscillator frequency, a count is accumulated to correspond with the number of times the oscillator output signal amplitude crosses a predetermined threshold level within a predetermined clocked interval. It is clear, however, that the amplitude of oscillation has to be sufficient such that even for the coin denomination to be recognised which gives the largest attenuation of the oscillator signal, the minimum amplitude of the oscillator signal must exceed the threshold level, in order to determine the oscillator frequency correctly. By increasing the power supplied to the oscillator following detection of coin arrival, this requirement can be met. On the other hand the power which the oscillator needs to be able to detect coin arrival is relatively low. Thus, the mean power consumption is also low. The power consumed by oscillators of known construction not employing this powering-up technique is dictated by the power necessary for peak frequency sampling and this is unacceptably high for certain applications requiring low mean power consumption, as mentioned above.

Turning now to another aspect of the invention, it is well known to use a sensing coil mounted alongside a coin track and connected in a self-oscillatory circuit for checking the validity and denomination of that coin. As the coin travels past the sensor, the frequency or amplitude of oscillation changes in dependence on the degree of interaction between the magnetic field established by the coil in the examination region and the coin itself. A detector circuit is used to determine whether the change is compatible with predetermined values indicative of acceptable coins. For high checking accuracy, it is essential that the near face of the coin should always have a particular spacing from, and orientation relative to, the coil itself at the time of maximum interaction between the magnetic field and the coin. For this purpose, it is usual to cant the passageway away from the vertical so that as the coin rolls down the coin track gravity tends to hold the coin in facial contact with one side wall of the coin track along which the coin is travelling. Moreover, within the space limits permitted, the inductive coil is located as far down the coin track as possible in order to allow sufficient distance for any side-to-side motion of the coin (such as non-linear coin flight or wobble) to be reduced as far as possible by the time the coin passes by the sensing coil. However, practical limitations on the width of coil validity checking apparatus limit the length of coin track available for allowing the motion of the coin to settle down, to a comparatively short distance which is often insufficient for completely overcoming inaccuracies due to slight side-to-side motion of the coin. Although the use of a single sensing coil can result in high sensitivity for the measurement made by the coil, the overall accuracy is limited by measurement scatter.

Measurement scatter can be reduced by connecting in series or in parallel with the sensing coil a further sensing coil which is mounted in the opposite side wall of the coin passageway. This further sensing coil has an inductance which is essentially identical to that of the first coil. It is found that this arrangement largely compensates for any variations in lateral position of the coin relative to the sensing coil as it passes by and therefore measurement scatter is significantly reduced. However, this compensation is achieved at the expense of considerable loss of sensitivity in the coin validation tests.

The invention, then, in another aspect aims to provide an improved inductive sensor arrangement.

According to the invention from a third aspect, there is provided a sensor arrangement for coin validity checking apparatus which comprises a coin passageway, along which a coin may be caused to travel through an examination region in which the coin is subjected to a changing magnetic or electric field produced by the sensor arrangement, and which further comprises means arranged to determine whether the degree of interaction, detected by the sensor arrangement, between the magnetic field and the coin in the examination region is indicative of an acceptable coin, the sensor arrangement comprising a pair of inductive or capacitive sensing devices which are mounted generally opposite, and spaced away from, one another on opposite sides, respectively, of the coin passageway which is so arranged that a coin travelling along the passageway will remain substantially in a predetermined lateral positional relationship relative to the sensing devices as it passes between them, the sensing devices being adapted for connection, in circuit, to the processing means, such that one of them is a measuring device which serves predominantly for detecting one or more characteristics of the coin dependent upon the degree of interaction between the field and the coin while the other one is a compensating device which serves predominantly to reduce measurement scatter due to variations in coin flight path, the inductance or capacitance values of the sensing devices being selected at different values so as to increase the ratio of measurement sensitivity to scatter.

By appropriate choice of the relative inductance or capacitance values for the sensing devices, the ratio of measurement sensitivity to scatter can be maximised, so as to optimise the overall measurement accuracy. The precise values chosen will depend on the range of variations in side-to-side motion encountered. The larger this is, the higher the ratio of the inductance values of the two sensing coils. Depending on the circumstances, the inductance ratio could be as low as 10% or as high as 90%.

The inductive coils can be connected together in series or parallel with the mutual inductance aiding or opposing. When the coils are connected together in series, the measuring coil will have the larger inductance value whereas when they are arranged in parallel the measuring coil will have the smaller value. Usually, the coin passageway will be canted at a shallow angle (approximately 10°) to the vertical plane so that, as far as possible, it can be ensured that the coin will travel down the passageway substantially in facial contact with one of the lateral walls of the coin passageway. Depending upon the particular coin characteristic or characteristics to which the measuring coil is intended to be responsive primarily, the measuring coil may be mounted in the near wall, against which the coin will run in facial contact, or in the far wall. For example, when measuring coin thickness, the measuring coil could be mounted in the far wall, whereas when measuring coin material, the measuring coil would generally be mounted in the near wall.

Similar considerations apply in cases where the sensing devices are in the form of capacitive elements.

With reference now to a fourth aspect of the invention, techniques are known for making a check on the validity of a coin which is largely dependent upon the material composition of that coin. One known technique involves transmitting an electromagnetic signal through the coin and determining the resulting attenuation on the signal. Transmitting and receiving coils on opposite sides of the coin track are required for this purpose. There are two major disadvantages with this technique. Firstly, the variation in attenuation produced by the several coin materials in common usage, often even in the coin set of any one particular country, is so large that, hitherto more than one signal frequency has been used to achieve adequate discrimination. For example, for copper, aluminium, mild steel and nickel a transmission frequency of 2 kHz is particularly suitable whereas for brass, cupro-nickel and non-magnetic stainless steel a frequency of typically 25 kHz is required. The need to use two frequencies involves either the use of two pairs of transmitting and receiving coils or mixing the two frequencies on the transmitting coil and separating out the two frequencies from the receiving coil with analogue filters. Such analogue circuitry is expensive and has relatively high power consumption. The second major disadvantage of this measuring technique is that for coins consisting of layers of different materials and at the frequencies adopted hitherto, the effect of the different materials is averaged. As a result, for a French 5 Franc coin which consists of a nickel-clad cupro nickel core and a German 5 DM coin which is cupro nickel over a nickel core, the degree of attenuation of the electromagnetic signal is difficult to distinguish as between these two coins.

Another modification involves determining the phase difference between the transmitted and received signals rather than the attenuation of the signal. Although this technique does have some advantages, its major disadvantage is the same as in the case of the attenuation technique, namely more than one frequency has, before now, been adopted to give good resolution over the range of materials used in coins and this again requires two channels and analogue filters.

A variation on measuring the transmission attenuation at a fixed frequency or frequencies is to measure the frequency which gives a fixed attenuation using a voltage controlled oscillator. For the full range of coin materials encountered, the transmission frequency has to be variable between about 100 Hz and 100 kHz. A voltage controlled oscillator capable of slewing quickly over this range can be provided by using a fixed frequency oscillator (1 MHz) and a voltage controlled oscillator operable over the range 0.8 MHz to 1 MHz, and by mixing the outputs of the fixed and variable oscillators and then separating out the difference frequency. Although the combined output is digital and therefore is suitable for programmable validity checks, the system bandwidth and power consumption again make this technique generally unsuitable.

In British Patent Specification No. 1,255,492, there is disclosed apparatus for testing and accepting and/or rejecting coins, in which each coin is subjected to a number of tests, one of which is an inductive test using a coil which is connected to a bridge sensing circuit energised from a 100 kHz oscillator. The inductive test is designed to examine the electromagnetic characteristics of each coin under test and the bridge network is brought into balance only by acceptable coins. Coins which do not balance the bridge are rejected. The apparatus is specifically designed to recognise the former British 6 d, 1/- and 2/- coins and the alloy used in the manufacture of each of these three coins is identical. Thus this test is designed to recognise a particular coin material. It may be capable of distinguishing from homogenous coins consisting of a different material but coins of sandwich construction might produce a response in the test which is indistinguishable from the coin material which the test is designed to recognise, due to the "averaging" effect of the different coin material layers.

An aim of the present invention is to provide improved apparatus which, when using only one frequency, is nevertheless capable of more reliably distinguishing between identically dimensioned coins of different constitution, e.g. sandwich coins and homogeneous coins.

According to the invention, then, from a fourth aspect, there is provided apparatus for checking the validity of a coin, comprising a coin examination region into which a coin may be caused to travel, an inductive sensor arrangement, which is arranged to subject a coin in the examination region to an oscillating electromagnetic field and is responsive to the degree of interaction between the field and the coin, and processing means arranged, in dependence on the response of the inductive sensor arrangement, to determine whether the degree of interaction is indicative of an authentic coin of an acceptable denomination, the field being oriented so as to penetrate the coin in a direction substantially normal to its faces and the frequency of the oscillating field being such that in the presence, in the examination region, of an authentic coin of the or each denomination acceptable to the apparatus, the skin depth of the field within the coin is below the depth of any surface cladding on the coin but not as deep as the central plane of the coin.

According to the invention from a related aspect, there is provided a method of checking the validity of a coin, in which the coin is caused to travel into an examination region in which the coin is subjected to an oscillating electromagnetic field by an inductive sensor arrangement which also responds to the degree of interaction between the field and the coin, and a determination is made, in dependence on the response of the inductive sensor arrangement, of whether the degree of interaction is indicative of an acceptable coin, the field being oriented so as to penetrate the coin in a direction substantially normal to its faces and the frequency of the oscillating field being such that in the presence, in the examination region, of an authentic coin of the or each denominations acceptable to the apparatus, the skin depth of the field within the coin is below the depth of any surface cladding on the coin but not as deep as the central plane of the coin.

In this specification "skin depth" is defined as the depth below the surface of the coin at which the current density is 1/e (where e is the exponential function) or 36.8% of the current or field density at the surface of the coin.

The precise choice of field frequency will depend upon the particular coins to be recognised, but usually the oscillating field frequency will be in a range whose upper and lower limits are substantially 80 kHz and substantially 200 kHz.

The particular choice of frequency is very significant. It is known that for very high frequency oscillators (for example 1 MHz) the skin depth (a measure of the degree of penetration of the electromagnetic waves into the coin) is very small so that transmit/receive techniques are impractical and even with inductive sensing techniques the validity check is largely influenced by the surface material of the coin. The skin depth is a function of the frequency of the electromagnetic field and of the conductivity and magnetic permeability of the material penetrated by the electromagnetic wave. It will be apparent therefore that at these very high frequencies, it is impossible to distinguish between a sandwich coin and a coin made wholly from the same outer layer material.

It is also known to use low frequencies (e.g. about 2 kHz) for which the "skin effect" is negligible and the strength of the electromagnetic wave within the material in the coin is not significantly attenuated. At such frequencies the different effects of different materials used in layered coins tends, with both transmission and inductive sensing techniques, to be averaged out and multi-layer coins are sometimes indistinguishable from coins consisting of one material only whose effect on the electromagnetic wave is the same as the average effect produced by a different-layered coin. Such known techniques can therefore in some circumstances be unsatisfactory.

On the other hand, it has now been appreciated that by selecting the magnetic field frequency to an appropriate value, typically within the range whose upper and lower limits are substantially 80 kHz and substantially 200 kHz, the magnetic field will penetrate to a significant extent through to the outer regions of the core of the coin lying beneath the surface regions but not to a substantial extent to within the heart of the core. Thus, with appropriate choice of the oscillation frequency, the skin depth will penetrate the outer layer of a sandwich coin into the outer regions of the core and in this way a distinguishable difference would occur in the attenuations produced by a French 5 Franc piece and a German 5 DM piece, for example. Of course, the precise value of frequency chosen will depend upon the particular coin materials of which the coins are made which the validator is specifically designed to recognise. A frequency of approximately 120 kHz is believed to be particularly suitable for many of the coin sets commonly in use in the world at the present time, including a multiplicity of sandwich coins and homogeneous coins made from widely differing materials.

With the inductive sensing arrangement forming part of an oscillator circuit whose frequency and amplitude change in dependence upon the degree of interaction between the oscillating magnetic field and in order to minimise the effect of unwanted parameters such as temperature effects, frequency drift and the like, it may be preferable for the ratio of oscillator output voltage in the absence of a coin to the minimum output voltage with the coin in the examination region to be determined.

The invention is concerned in a sixth aspect with converting an alternating signal into a direct current signal with very low power consumption and high accuracy.

According, then, to the invention from a sixth aspect, there is provided a rectifying circuit which comprises first and second circuit networks, means to present the positive and negative half-cycles of a sinusoidal input signal alternately to the two networks, a smoothing device in each branch network to convert the respective half-wave signal into a DC signal, and means to combine the DC signals from the two branch networks so as to produce an output signal whose magnitude is equal to the sum of the moduli of the two DC signals.

BRIEF DESCRIPTION OF THE DRAWINGS

For a better understanding of the invention and to show how the same may be carried into effect, reference will now be made, by way of example, to the accompanying drawings, in which:

FIG. 5 is a simplified circuit diagram of a rectifying and smoothing circuit included in the circuitry of FIGS. 3 and 4;

FIG. 6 is a signal diagram illustrating operation of the rectifying and smoothing circuit;

DETAILED DESCRIPTION OF EMBODIMENTS

The coin validity checking apparatus to be described with reference to FIGS. 1 and 2 has no credit totalising or mechanism control (such as change-giving) functions. It is capable merely of performing validity checks on inserted coins and is adapted, by way of example, to recognise coins of up to six different denominations. For this purpose, it has six individual output terminals J–P (FIG. 4) at an appropriate one of which a signal will be produced, after an acceptable coin of one of the six recognised denominations has been inserted into and cleared the apparatus, to indicate the denomination of the coin. In addition, an accept signal will appear at terminal Q which could be used, for example to operate a coin accept/reject gate so as to admit the coin into an accepted coin chute. Alternatively, if the coin is not judged to be acceptable, no signal will appear at terminal Q and the accept/reject gate directs the coin into a rejected coin chute.

Figure 1:
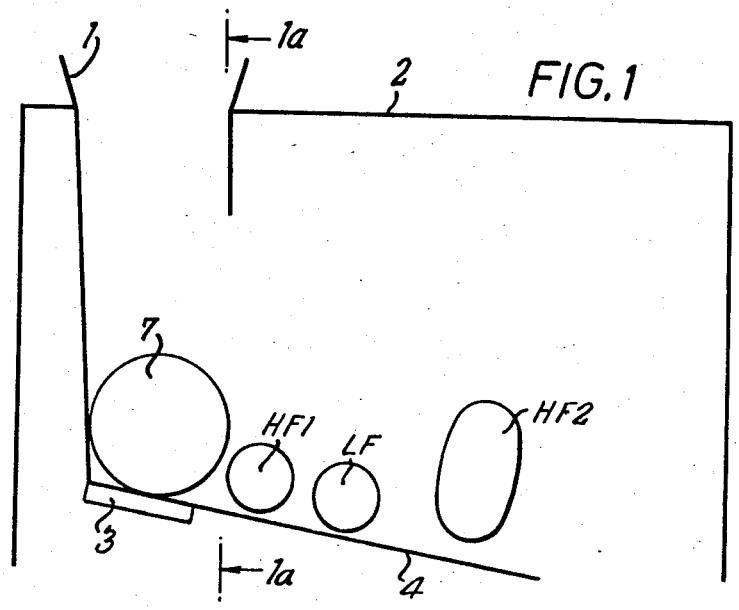
FIG. 1 is a diagrammatic side view of a coin validator showing in particular the arrangement of three inductive sensors along a coin track.
Figure 2:
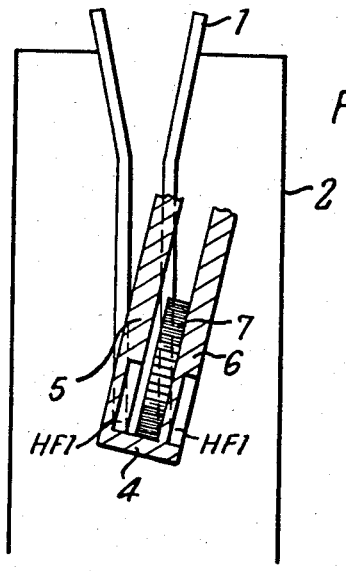
FIG. 2 is a sectional view along line 1*a*—1*a* in FIG. 1.

Referring to FIGS. 1 and 2, the coin validity checking apparatus comprises an inlet hopper 1 or slot in the top of the casing 2 of the apparatus through which a coin can be dropped to be tested. The coin travels downwardly under the action of gravity and strikes an energy dissipating device 3 which is designed to absorb the impact energy of the coin without causing the coin to rebound or bounce. Accordingly, the coin, in position 7, starts to roll under gravity along a downwardly inclined coin track 4 to pass, successively, three inductive sensors HF1, LF and HF2. The first sensor HF1 comprises two circular coils arranged one at each side of the coin path in front and rear, spaced-apart, side walls 5 and 6 (see FIG. 2) which, together with the coin track 4, define a coin passageway. FIG. 2 shows clearly that the side walls 5, 6 are canted backwardly away from the vertical at a shallow angle (typically approximately 10°) so as to ensure as far as possible that as the coin rolls past the sensors HF1, LF and HF2 in turn, it will be in facial contact with the rear side wall 6. The lower edges of the coils of HF1 are spaced slightly above the coin track 4. The diameter of the coils is smaller than the smallest coin which is to be recognised so as to minimise "diameter effects". Similarly, the second sensor LF comprises two circular coils mounted one in the side wall 6 and the other in the front wall 5, and both coils are arranged with their lower edges slightly above the coin track 4. The diameter of the coils is smaller than the smallest coin. The third sensor HF2 which is mounted in the side wall 6 comprises a single coil but this coil has an oval-shape and is arranged with its major axis extending in a generally upward direction relative to the coin track. As shown, the lower edge of the HF2 sensor is spaced above the track 4 but it could alternatively be arranged below.

Figure 9:
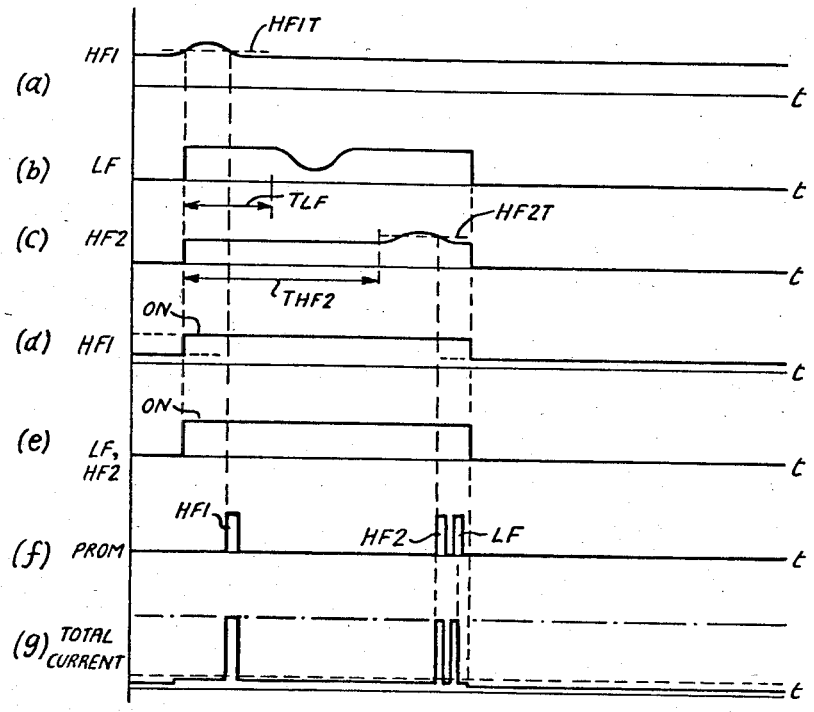
FIG. 9 is a waveform diagram indicating the time when power is supplied to different parts of the discriminating and control circuitry.

The sensors HF1 and HF2 are connected in respective, self-excited, oscillatory circuits 300,301 (FIGS. 3 and 4) which in the absence of a coin from the examination region of the apparatus and when energized will oscillate at a particular idle frequency. The idling frequency in each case is a high frequency (typically 500–1500 kHz). When a coin rolls down the track 4 towards each sensor and enters the oscillating magnetic field due to the sensor, an interaction will occur between the coin and the oscillating magnetic field. This causes a shift in the oscillation frequency of the self-excited circuits, reaching a maximum value when the coin is directly facially opposite the sensor. The oscillation frequency will then start to reduce continuously as the coin travels past the sensor until the frequency level returns to its former idling level. The oscillation frequency waveforms for the sensors HF1 and HF2 as the coin 7 rolls down the track 4 are shown in FIGS. 9(*a*) and (*c*) respectively. The coin also absorbs energy from the oscillatory circuit, thereby damping the circuit and reducing the amplitude of its oscillating voltage. The discriminating and control circuitry is designed to investigate the peak frequency shift but to minimise the voltage amplitude reduction. The manner in which this is achieved is described in more detail below with particular reference to FIGS. 3 and 4. For each sensor, starting from its idling frequency, the peak frequency shift will in each case depend upon several characteristics of the coin such as diameter, material, thickness and surface detail. However, each of the sensors HF1, HF2, owing to its size and shape, arrangement relative to the coin track, and oscillation frequency, is designed to respond predominantly to one particular characteristic. Thus, the HF1 sensor is responsive mainly to coin thickness. The HF2 sensor on the other hand is responsive primarily to coin diameter. When processing the HF1 and HF2 frequency signals, a comparison is made to determine whether the peak frequencies derived from each coil are compatible with sets of predetermined upper and lower limit values indicative of acceptable coins of particular denominations.

The LF sensor is also connected in a self-excited oscillatory circuit 302 (FIGS. 3 and 4) but this oscillates at a significantly lower frequency. For special reasons which are discussed below, the frequency is selected in a range whose upper and lower limits are substantially 80 kHz and 200 kHz, and preferably at a frequency of about 120 kHz. In the case of the LF sensor, a coin rolling down the track 4 past the sensor will bring about a frequency change and amplitude attenuation of the oscillating output signal of the circuit 302 but in this case the frequency change is small and ignored and instead a comparison is made to determine whether the signal amplitude at peak attenuation is compatible with groups of upper and low limit values corresponding to acceptable coins of recognised denominations. The LF sensor is predominantly responsive to the material characteristics of coins.

Figure 4A:
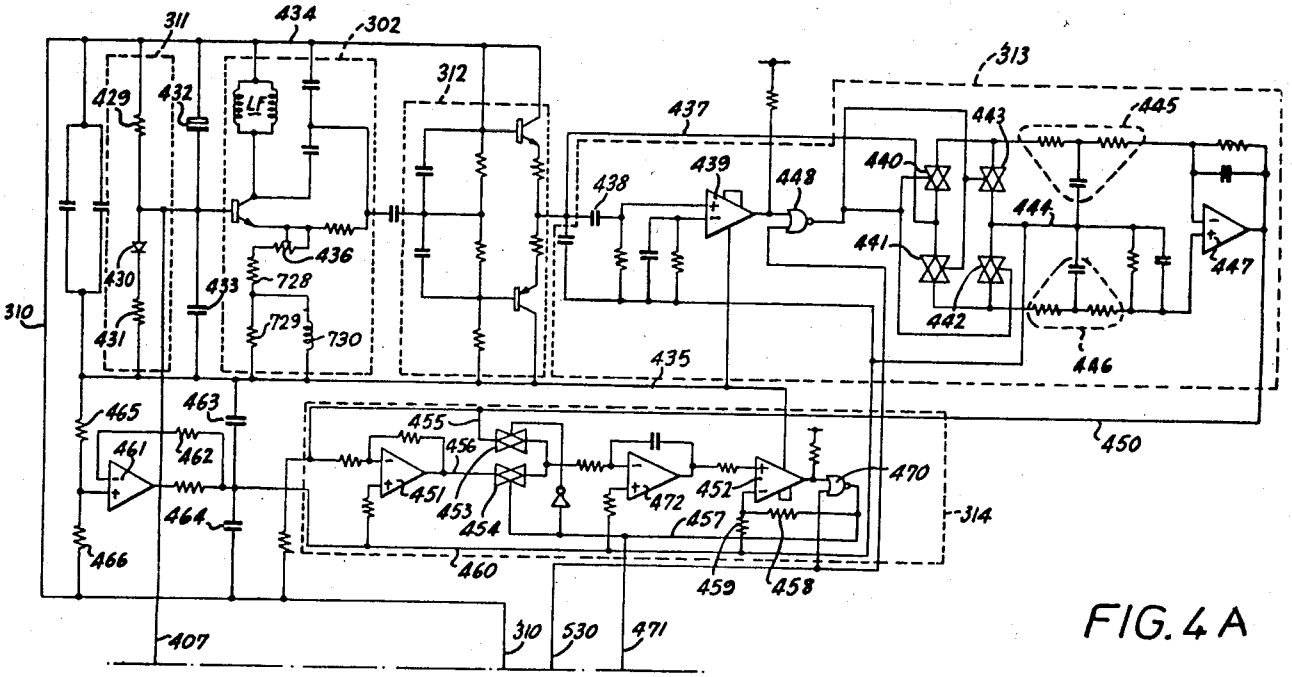
FIGS. 4A and 4B are a detailed circuit diagram of the circuitry.
Figure 4B:
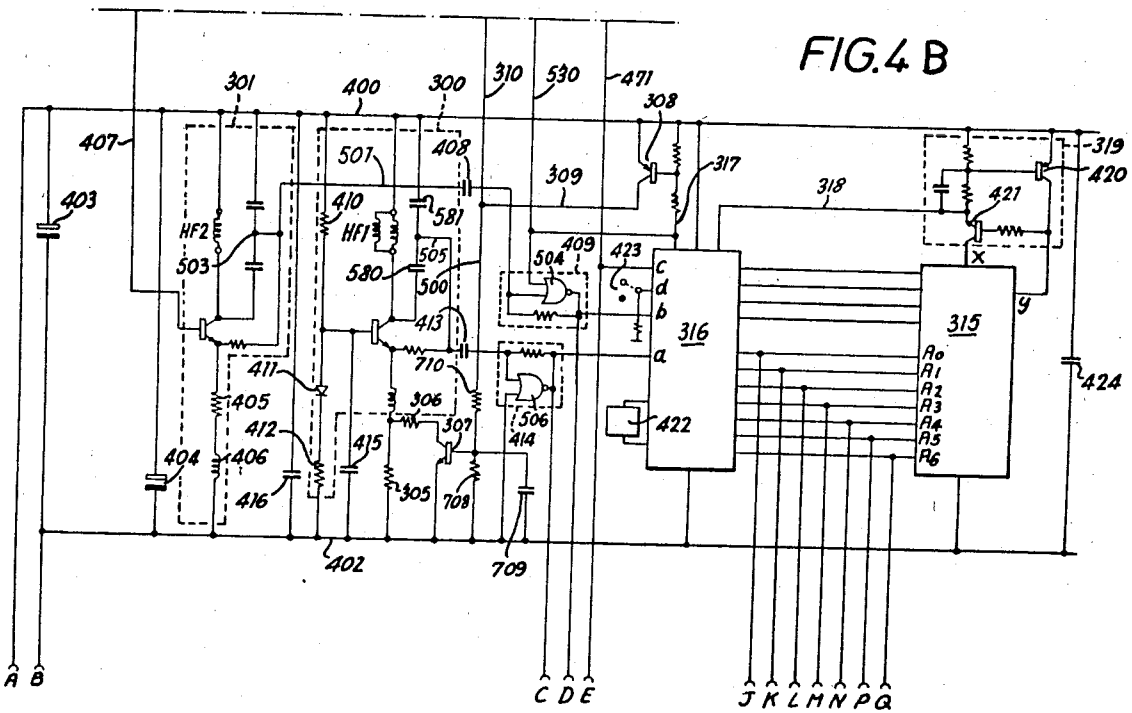

If the validation (discrimination and control) circuitry determines that a coin which has cleared the HF1, LF and HF2 sensors has passed an appropriate combination of tests for any one particular coin denomination which is recognised by the coin checking apparatus, it generates an accept signal on terminal Q (FIG. 4). If one or more tests is failed, no accept signal is generated. The presence or absence of an accept signal in terminal Q is used to control the position of an accept-/reject gate, as mentioned above.

Figure 3:
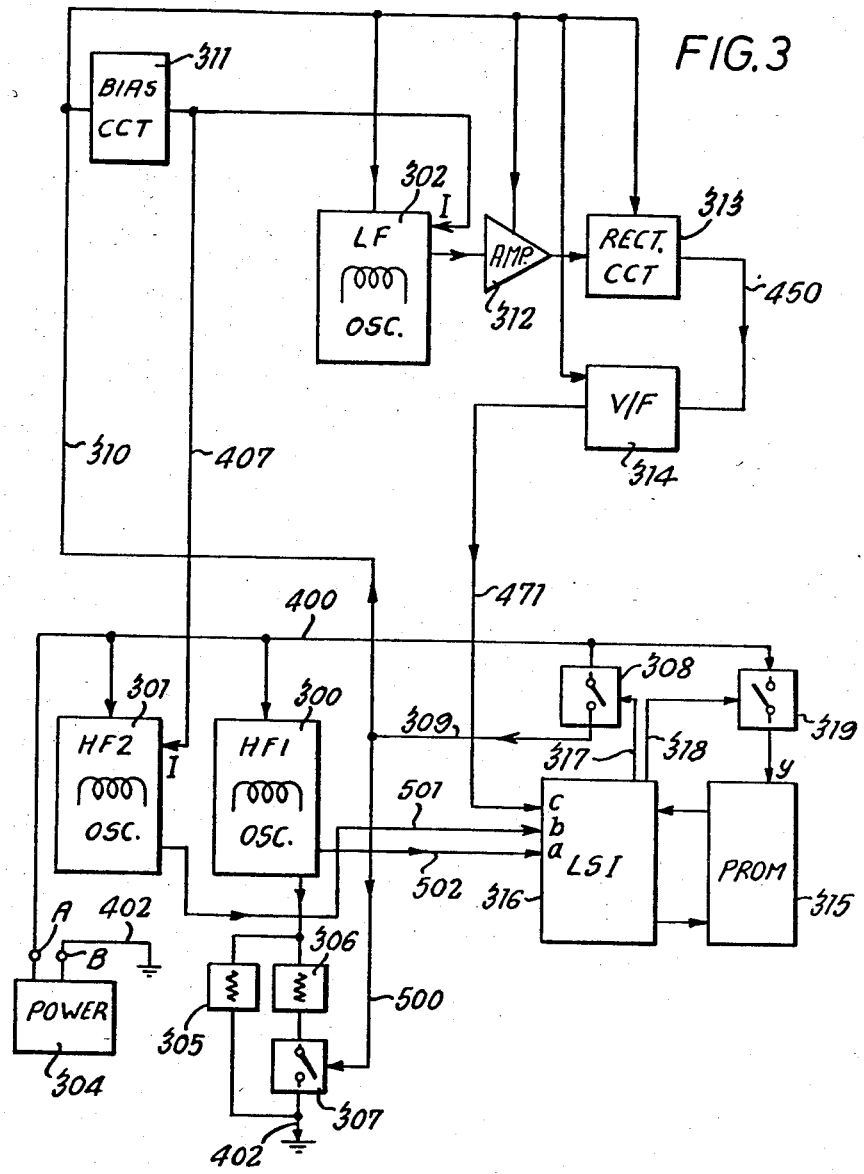
FIG. 3 is a simplified block circuit diagram of discriminating and control circuitry used in conjunction with the inductive sensors.

Referring to FIG. 3, when the discrimination and control circuitry is switched on initially in the absence of a coin, the LF and HF2 oscillatory circuits 301,302 are not energized because no voltage signal is applied to their external bias inputs I, but HF1 circuit 300 is set in a standby or idling condition because the potential of power source 304 is permanently applied to its internal bias circuit. In this condition, the HF1 oscillator 300 draws a small current, typically less than about 1 mA at 5 volts, from an external power source 304, the HF1 oscillatory circuit being connected back to the return terminal of the power supply through a resistive circuit (such as a resistor) 305. Connected in parallel with the circuit 305 is a branch network comprising a resistive circuit (such as a resistor) 306 which is connected in parallel with resistive circuit 305 when an electronic switch 307 is closed by a voltage signal on line 500. In the HF1 standby mode, electronic switch 307 is open.

A power-up electronic switch 308, when closed, by a "power-up" signal on line 317, causes power to be supplied from power source 304 along line 309 both to close switch 307 and to supply power along power-up line 310 through a biasing circuit network 311 to the HF2 oscillator 301, the low frequency oscillatory circuit 302, an amplifier 312, a rectifying and smoothing circuit 313 and a voltage-to-frequency converter 314. The power supplied on line 310 via the biasing circuit network 311 brings the HF2 and LF oscillatory circuits 301 and 302 into operation. Also, the closing of switch 307 so as to bring resistive circuit 306 into parallel connection with resistive circuit 305 reduces the effective resistance between the oscillatory circuit 300 and the return terminal of the power unit 304 and this has the effect of stepping up the oscillatory circuit 300 from its idling or standby condition to full energisation. This increases the oscillation amplitude.

The output signal from the LF oscillatory circuit 302 is buffered in amplifier 312 and then fed to a rectifying and smoothing circuit 313 which produces a direct current signal at its output which is proportional to the magnitude of the oscillatory circuit output signal. This analogue signal is converted in the voltage-to-frequency converter 314 into a corresponding digital frequency signal. The amplifier 312 serves to isolate the LF oscillatory circuit from the loading of the rectifying and smoothing circuit 313.

Figure 8A:
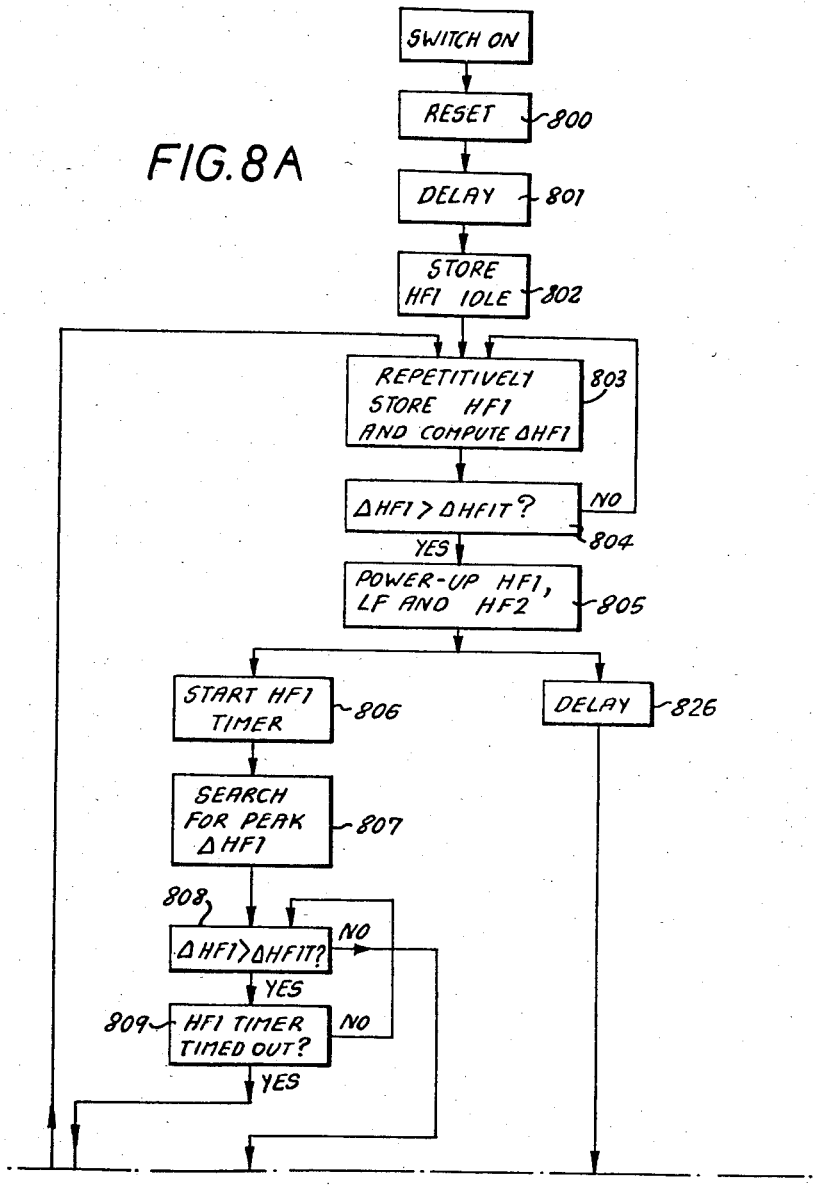
FIGS. 8A and 8B are a flow chart showing how a large scale integrated circuit (LSI) included in the circuitry of FIGS. 3 and 4 is preprogrammed to operate.
Figure 8B:
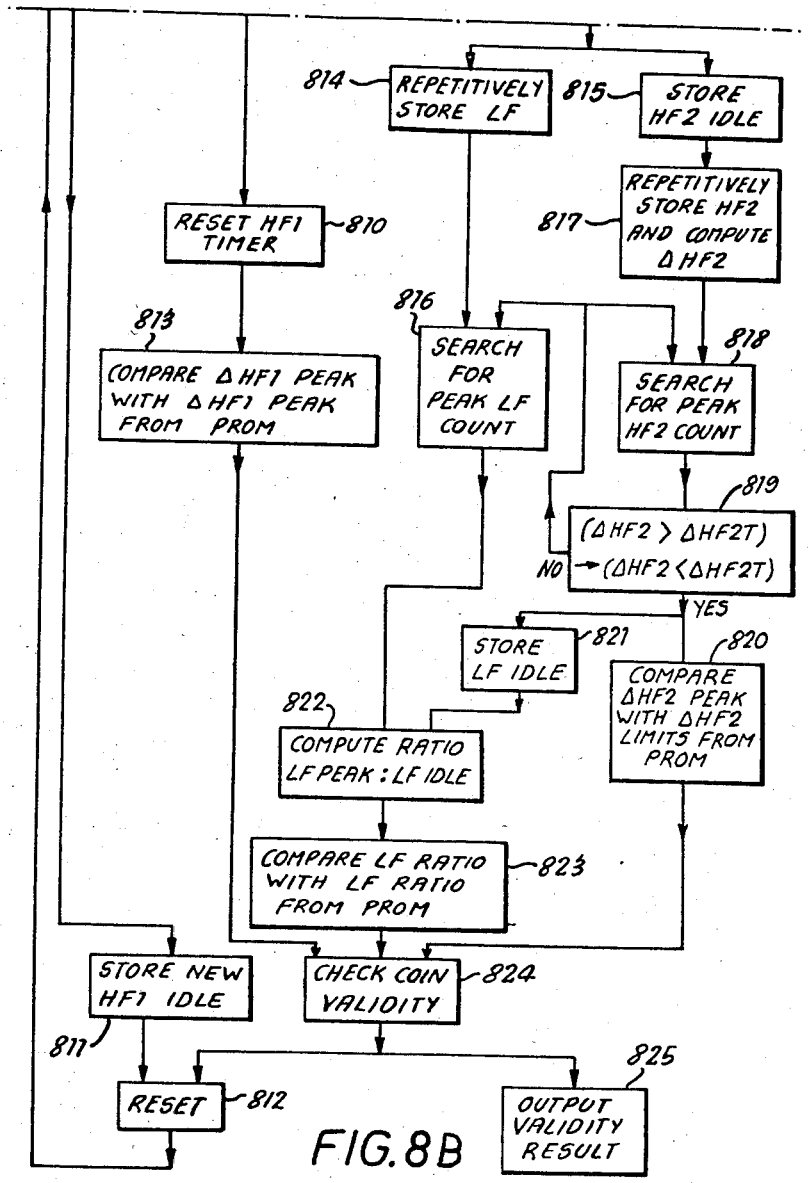

In a programmable-read-only-memory (PROM) 315 are stored upper and lower limit values for each of a number (in this example 6) of different coin denominations which the discrimination and control circuitry is designed to recognise. The PROM 315 is energized at its input pin Y from the power unit 304 when an electronic switch 319 is closed by a "PROM-enable" signal generated on line 318. The operation of all the circuit elements of the validation circuitry is controlled by a large scale integrated circuit (LSI) 316 having inputs a, b, c connected to output lines 501, 502 and 471 of the oscillatory circuits HF2, HF1 and the voltage-to-frequency converter 314, respectively. The LSI handles the input data it receives in accordance with a predetermined program, the flow diagram for which is shown in FIG. 8, and generates, when appropriate, "power-up signals on line 317 and "PROM-enable" signals on line 318 so as to read out the sets of upper and lower limit values stored in the PROM. The LSI is also operative to compare the measured HF1, LF and HF2 values with limit values read out from the PROM to determine whether each coin under test is an acceptable coin of a recognised denomination.

Referring now to FIG. 4, terminals A and B serve for connecting the power supply and return terminals of the external power source 304 (FIG. 3) to the validation circuitry. Terminal A is connected to a supply voltage line 400 and terminal B is connected to a negative potential (0 volts) line 402.

The HF2 oscillator 301 is connected between lines 400,402. Oscillatory circuit 301 suitably is a Colpitt's circuit whose transistor has its emitter connected to negative potential line 402 through a series arrangement of an inductance 406 and resistance 405. The oscillator becomes operative when a bias signal is applied on line 407 to the transistor base. The output 503 of the HF2 oscillatory circuit is connected by line 501 through capacitor 408 and a buffer circuit 409 to input b of the LSI 316. The buffer circuit 409 enables the output signal of the HF2 oscillatory circuit 301 to be monitored on output terminal D without affecting the oscillation frequency.

The two coils of sensor HF1 which in this example is arranged in parallel opposition are connected in a Colpitt's oscillatory circuit in corresponding manner to sensor HF2. However, as already mentioned oscillator HF1 is always at least idling owing to a biasing voltage signal which is applied to the base of the oscillator transistor base from a voltage divider comprising a series arrangement of a resistor 410, a diode 411 and a resistor 412 connected between the positive and negative voltage lines 400,402. The effective resistance of the branch connecting the emitter of the oscillator transistor to the negative voltage line 402 can be reduced by a power-up signal applied to the base of electronic switch 307, which takes the form of a switching transistor, so as to connect resistance 306 in parallel with resistance 305. The effect of this is to switch the HF1 oscillatory circuit 300 from its idling or standby condition onto full power. The ratio of the capacitances of the two capacitor 580,581 in the tuned circuit of the HF1 oscillator is chosen at approximately 3:1 to minimise the attenuation of the output signal from the output 505 of the oscillator. This output of the HF1 oscillatory circuit is connected through capacitor 413 and a buffer circuit 414 to input a of the LSI 316. The buffer circuit 414 is continuously operative to allow the oscillation frequency of the HF1 oscillator to be monitored at terminal C without modifying its value. Capacitor 415 connected between the base of the oscillator transistor and the negative line 402 serves as a decoupling capacitor for the transistor. Further capacitors 403,404 and 416 connected between the voltage lines 400,402, serve to provide high frequency filtering and energy replenishment. This prevents fluctuations in the supply voltage which could otherwise upset operation of the validation circuitry.

The base of switching transistor 307, which is connected to negative line 402 through a parallel arrangement of a resistor 708 and capacitor 709, is arranged to receive a voltage signal along line 500 through a resistor 710 when electronic switch 308, again in the form of a switching transistor, is switched on by a "power-up" signal supplied to its base on line 317 from the LSI 316. The electronic switch 319 comprises a first switching transistor 420 which supplies a voltage signal to the base of a further switching transistor 421, when the LSI 316 generates a "PROM-enable" signal on line 318 and also switches power to input Y of the PROM. The voltage signal applied to the base of transistor 421 simultaneously causes a signal to be applied to an enable input x of the PROM 315 to enable the LSI 316 to address the PROM and read-out stored data.

A capacitor 424 connected between the lines 400,402 stores energy from the external power source so that the stored energy can be used to augment the power supplied to the PROM 315 when the transistors 420,421 are switched-on.

The PROM 315 has seven address inputs AO–A6, which enable the LSI 316 to request the PROM to deliver on output lines DO–D3 signals representative of the sets of upper and lower limit values, stored in the PROM, corresponding to the coin denominations associated with the appropriate decoded address line AO–A6. The address lines AO–A5 are respectively connected to the corresponding coin output terminals J, K, L, M, N, and P. Address line A6 is connected to terminal Q. The PROM address signals and the output signals are carried on the lines AO–A6 at different times. By using multiplex operation to carry the several sets of data on lines AO–A6, the number of pins required on the LSI, and thereby also cost, is reduced.

The LSI operation follows a program which proceeds in accordance with clock pulses from a clock circuit 422 supplying, simultaneously, two sets of clock pulses at frequencies of 0.5 MHz and 250 Hz. The reason for two sets of clock pulses is that there is a wide variety of different timing waveforms required in the LSI 316 and it is convenient to generate these using the two significantly different, base clock frequencies and appropriate dividers. The LSI provides a signal on an output terminal G to enable the clock pulse rate to be monitored. In addition, the LSI preferably, as shown, has a setting input d provided with a switch 423 for preselecting one of two different arrival/departure threshold levels for the HF2 sensor.

The lower frequency (LF) oscillatory circuit 302 is similar to the two high frequency oscillators (HF1 and HF2) and again comprises a Colpitt's oscillator, the two coils of the LF sensor being arranged in parallel with their mutual inductance opposing in this example. The oscillator transistor is provided with a series arrangement of a resistor 429, a diode 430 and another resistor 431 together constituting the biasing network 311, and also two decoupling capacitors 432,433 which, together with the series network 429–431, are connected between on the one hand a switched supply line 434 supplied from lines 310 so as to receive the power-up voltage when the LSI generates a power-up signal on line 317, and on the other hand a negative voltage line 435 which is at the same potential as negative voltage line 402. The emitter circuit of the Colpitt's oscillator includes a variable resistance 436 and fixed resistors 728 and 729 in conjunction with inductance 730, to enable the oscillation amplitude, with and without a coin present to be set within the dynamic range of the validation circuitry. The oscillating output signal from circuit 302 is fed to amplifier 312 which as shown takes the form of an emitter follower buffer whose output is fed on line 437 to the rectifying and smoothing circuit 313 and also fed, via capacitor 438, to a differential amplifier 439, functioning as a zero-crossing detector, which serves to control the operation of the circuit 313.

As shown in FIG. 5, the rectifying and smoothing circuit 313 comprises two CMOS switching devices 440,441 arranged in parallel branches 510,511 supplied from the output of the emitter-follower buffer 312, respective branches each connecting one of the branches 510,511 to a line 444 held at a reference voltage and including a further CMOS switching device 443,442, respective filter networks 445,446 for the two branches 510,511, and an integrating differential amplifier 447 whose inputs receive the output signals from these filter networks. FIG. 6 shows at (a) the sinusoidal output signal from the emitter-follower buffer circuit 312. The zero-crossing detector 439, whose output is gated to the four CMOS switching device through NOR gate 448 (FIG. 4) so that it controls these switching devices only when receiving an enabling signal on a line 530 from the power-up line 317, controls the CMOS switching devices in pairs 440,442 and 441,443 so that the positive half cycles of the signal on line 437 appear at the input to filtering network 445 while the negative half cycles appear at the input to filtering network 446. These signal waveforms are shown at X and Y, respectively, in FIG. 6(*c*) and (d) while the switching waveform from the zero-crossing detector is shown in FIG. 6(*b*). As shown in FIG. 4, the filter networks 445,446 are RC filters which each produce an average DC level from waveforms X and Y which is fed to the corresponding input of the integrating differential amplifier 447. The integration provides a second stage of filtering while the effect of being a differential amplifier causes the magnitudes of the positive and negative inputs to be added arithmetically to produce a negative DC output voltage which appears on output line 450.

It is to be noted that as the amplifier 447 receives substantially DC input signals, it does not require a large bandwidth or a high slew rate. The zero-crossing detector 439 is a switching device having low power consumption and the CMOS devices 440–443, which are energised only when the power-up signal, applied on line 530 to one input of NOR gate 448, is generated by the LSI have negligible power consumption.

The use of the differential amplifier 447 is important for measurement accuracy. Consider an input waveform having a DC offset component referred to the reference supply. This DC level will be alternately presented at X and Y which will give identical DC components of the same polarity and the resultant output from the differential amplifier will be zero. The CMOS analogue switches 440–443 need not have zero ON resistance since it is only required that the ON resistance for the four devices be similar, which is inherent when, as is preferred, they are integrated in one device. The use of four switches and the low impedance buffer 312 ensures that the filter network inputs always see a constant, low source impedance and therefore the differential measurement is always accurate.

Thus, the disclosed rectifying and smoothing circuit 313 provides a DC signal from an input sinusoidal waveform with very low power consumption. The same result would not be achieved with a simple diode rectifier because of the off-set voltage due to the forward voltage drop of the diode and the temperature coefficient of that voltage. A precision rectifier using two diodes and an operational amplifier removes these sources of error but the operational amplifier would require a gain bandwidth product of about 100 times the operating frequency (i.e. $100\times120$ kHz$=12$ MHz) and a fast slew rate. The circuitry described with reference to FIGS. 4, 5 and 6 removes the need for these requirements.

For the duration of the power-up signal generated by the LSI, the negative DC voltage signal on line 450 (FIG. 4) is fed on a first branch 455 directly to a CMOS switching device 453 and on a second branch, which incorporates a unity gain inverting amplifier 451, to a second CMOS switching device 454 by way of line 456. These CMOS switching devices are alternately switched by a common digital signal on output line 457. The switched voltage from the switching device 453 or 454 is fed to non-inverting input of an integrating amplifier 472 which generates an increasing or decreasing ramp output voltage depending upon the algebraic sign of the input voltage signal. The ramp signal is compared in a voltage comparator 452 with a reference voltage on the inverting input of the comparator. This voltage is switched between values $+V_t$ and $-V_t$ by the output signal of the comparator 452 which is fed back through a resistive network comprising resistors 458,459.

A reference voltage V ref is provided on line 460 from an operational amplifier 461 having its inverting input biased from the power-up line 310 through a voltage dividing network comprising equal value resistors 465 and 466 connected between the negative line 435 and the power-up line 310. Capacitors 463 and 464 are decoupling capacitors. The reference voltage on line 444, the reference voltage of the zero-crossing detector 439, the voltages on the non-inverting inputs of amplifier 451 and integrator 456, and the reference voltage $\pm V_t$, are all derived from the reference voltage $V_{ref}$ on line 460.

Figure 7:
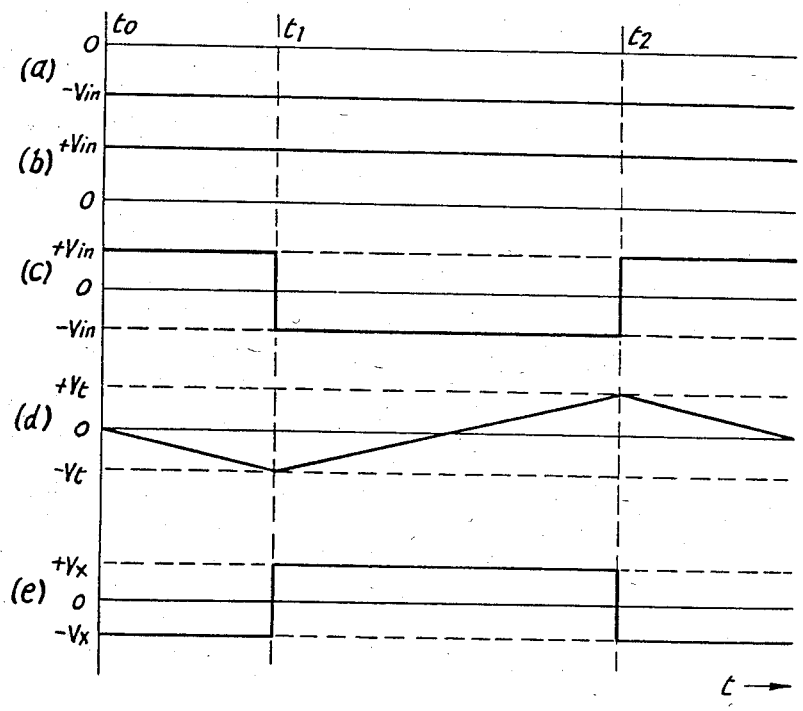
FIG. 7 is another signal diagram showing the mode of operation of an analogue-to-digital converter to which the output signal from the smoothing and rectifying circuit is supplied.

Operation of the voltage-to-frequency converting circuit 314 will now be described with reference to FIG. 7. The DC output voltage from the rectifying and smoothing circuit 313 which is fed on line 450 as the input voltage to the voltage-to-frequency converter 314, is denoted by $-V_{in}$ (V ref on line 460 is denoted as 0 volts). Consider time $t_o$ when the voltages on branches 455,456 at the inputs to the switching devices 453,454 are shown in FIGS. 7(*a*) and 7(*b*), respectively. At this time, the comparator output signal appearing at the output of a NOR gate 470 has the negative value $-V_x$ (FIG. 7(*e*)) and this signal applied simultaneously to control inputs of switching devices 453,454 admits the voltage $+V_{in}$ to the inverting input of integrating amplifier 472 while withholding the $-V_{in}$ voltage. FIG. 7(*c*) shows the input voltage to the integrating amplifier 472. This amplifier accordingly supplies at its output a ramp voltage $V_{out}$ (see FIG. 7(*d*)) having the value $-V_{in}t/RC$, where RC represents the effective resistive and capacitive values of the integrator 472. The output voltage of integrator 472 is compared, in a voltage comparator 452, with the threshold voltage, which at this time has the value $-V_t$, applied to the inverting input and wheh the output ramp voltage equals the reference voltage (at time $t_1$), the output of comparator 472 changes from low to high so as to have a new value $+V_x$ (FIG. 7(*e*)). $-V_x$ is substantially the same potential as that of line 435 while $+V_x$ is substantially the same potential as that of line 310. The change in the output voltage of comparator 452 due to the resistive network 458,459, has the effect of changing the reference voltage on the inverting input of comparator 452 to $+V_t$. At the same time, the new output of comparator 452 switches the devices 453,454 so that the voltage applied to the inverting input of integrator 472 now has the value $-V_{in}$. This is indicated in FIG. 7(*c*). The integrator output voltage then rises steadily with slope V/RC until (at time $t_2$) the integrator output voltage equals the value $+V_t$, whereafter the circuit switches once more and the integrator output again becomes a falling ramp voltage. It will be understood, therefore, that (for the duration that the power-up signal is generated by the LSI) a pulsed voltage signal is generated-on line 457 from the output of NOR gate 470 which passes, along line 471 to the LF input c of the LSI 316. It will be seen that the positive and negative slopes of the integrator output voltage are proportional to the magnitude of $V_{in}$. Therefore, the frequency of the signal generated on line 471 is linearly proportional to the amplitude of the output signal from the LF oscillating circuit 302.

It is to be noted that the selected magnitude of the reference voltage $V_{ref}$ is not particularly significant as it is used as a common reference voltage for the rectifying and smoothing circuit 313, inverting amplifier 451, integrator 472 and comparator 452. Suitably, the selected magnitude is equal to approximately half the "power-up" voltage on line 310 in order to keep the detecting circuitry linear throughout its dynamic range. It is also pointed out that the use of the same input voltage (i.e. the output voltage from the rectifying and smoothing circuit 313) for the positive and negative half cycles of the input voltage waveform of the integrator 472 ensures that there is no off-set in the output frequency signal on line 471. In other words when the input voltage $V_{in}$ is near zero, the frequency of the signal on line 471 is near zero to.

It is further pointed out that the period of the LF signal on line 471 is proportional to $V_t$ which in turn is proportional to the power-up voltage but since $V_{in}$ increases with the power-up voltage ($V_{in}$ is proportional to the amplitude of the low frequency oscillator output signal), the output period is substantially independent of the power-up voltage.

Essentially, the function of the LSI is to process the HF1, HF2 and LF signals which it receives on inputs a, b, c in such manner as to determine whether the coin under test is an acceptable coin of a recognised denomination. In the case of the HF1 and HF2 signals, the LSI determines the instantaneous frequencies in each case by counting the number of times the HF signal crosses a preset threshold level ($V_{th}$ referred to in the description of FIG. 10) in a predetermined clock interval. For the LF signal, the LSI counts the number of clock pulses generated by the clock circuit 422 during each cycle of the LF signal and therefore measures the instantaneous period of the LF signal.

Ideally, in order to compensate for the effect of drift, temperature change and like factors, the LSI computes the ratio of the peak value of each of the HF1, HF2 and LF counts to the corresponding idling levels (i.e. no coin in the examination region of the corresponding sensor) existing just prior to or after the peak level, and then compares the calculated ratios against the sets of predetermined upper and lower limit values read-out from the PROM 315. In practice, for the HF1 and HF2 signals, each peak count is not significantly different from the idle value and so a sufficiently close approximation to full compensation is obtained by computing the difference between the peak and idling frequency values. However, the attenuated peak LF amplitude for some coin denominations is very much smaller than the idle value and so the LSI is programmed to compute a quotient value in the case of the LF count.

The LF output signal on line 471 is a square wave of substantially 1:1 mark ratio and its frequency varies in accordance with the magnitude of oscillation of the LF oscillatory circuit 302. In order to measure accurately the peak attenuation of the coin moving past the LF sensor, each measurement sample made by the LSI should preferably not last more than 2.5 ms. Therefore, for 0.1% accuracy the input frequency would have to be 400 kHz minimum. To minimise the effect of integrator bandwidth and signal propagation delay through the comparator 452, the period of the LF input signal to the LSI rather than the input frequency is measured, as already indicated. In a practical example, the maximum period has been chosen to be 2 ms and a 512 kHz clock is gated for each period to give a maximum count of 1024 in that period. This maximum period corresponds to the minimum oscillator amplitude which corresponds to the coin denomination giving rise to the highest attenuation. The peak-to-idle ratio computed by the LSI is chosen to give a full-scale measurement for an 8:1 attenuation ratio coin. The minimum period, corresponding to no coin present, is therefore 0.25 ms. This "idle" period is measured over 8 successive periods to increase the resolution and can be measured either before the coin is present or after the coin has left the measurement field. After the measurement, the LSI 316 has two ten bit binary numbers in store corresponding to two input periods. The first binary number (idle) is a count of the total pulses generated during eight successive idle periods. The second ten bit binary number (peak) is a count of the maximum number of clocked pulses generated during any single input period existing between HF1 arrival and HF2 departure. The LSI performs the binary division.

$$(\text{Peak/idle}) \times 512 = \text{normalized peak}$$

The normalized peak is a nine bit binary number corresponding to the attenuation of the coin and is compared in the LSI with sets of upper and lower limit values read out from the PROM 315.

It is to be noted that the magnitude of the power-on voltage, the 512 kHz clock frequency, the values of RC in the integrator, the gain of the rectifying and smoothing circuit 313 and the absolute amplitude of the LF oscillatory circuit 302 do not affect the normalized peak value providing that the low frequency detecting circuitry has a linear response.

Operation of the entire coin checking apparatus will now be described, particular reference being made to FIG. 8 which shows the several steps (800–842) performed by the LSI.

It is assumed that the validation apparatus is switched off and no coin is present anywhere in it. The apparatus is then switched on. In the following description, to facilitate an understanding of the operation of the LSI, a simple mode of handling the HF1, HF2 and LF input signals to the LSI will be described although, in practice, more sophisticated techniques might be adopted, for example handling the LF signal on line 471 in the manner described above.

Step 800

The LSI resets all registers, latches, timers and sequencers.

Step 801

A delay, for example 256 ms, is timed out to allow the HF1 oscillatory circuit sufficient time to settle down into a regular oscillation frequency in its standby or idling mode.

Step 802

Next, the HF1 idle count is accumulated by the LSI.

Step 803

Figure 10:
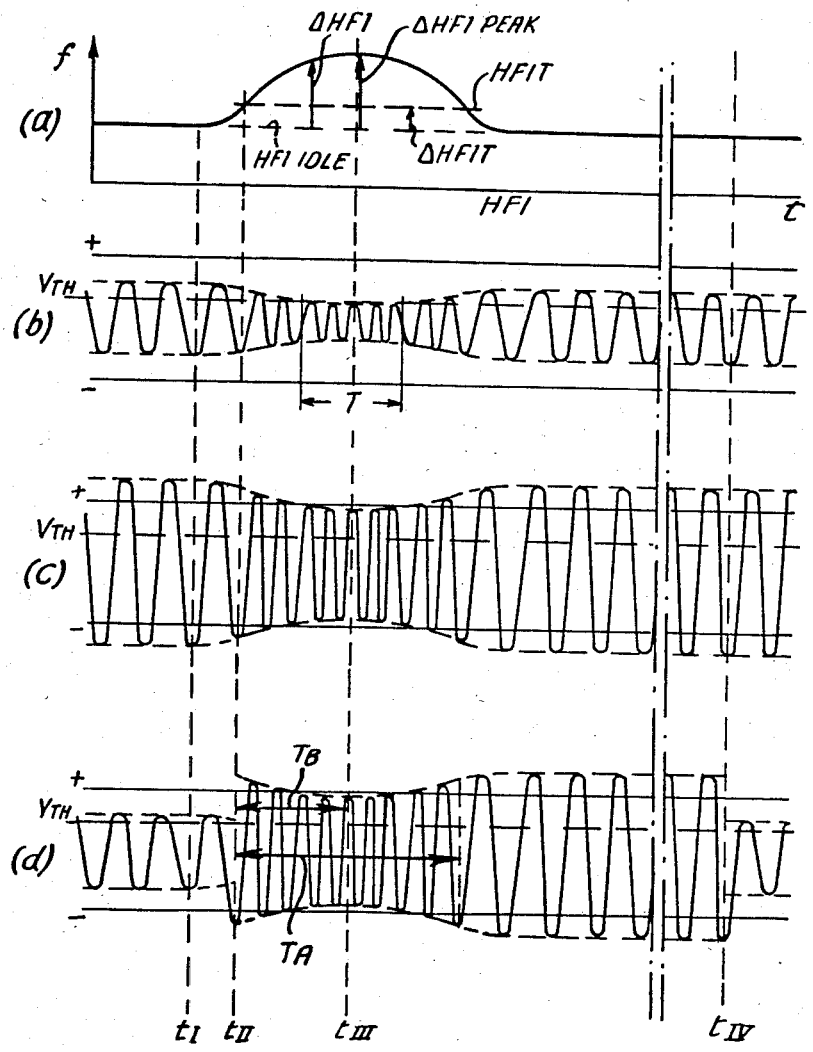
FIG. 10 shows various signal waveforms to illustrate the significance of powering-up a high frequency oscillator in the discriminating and control circuitry.

In the manner described above, the LSI repetitively accumulates a count corresponding to the number of times the oscillator signal crosses the $V_{TH}$ threshold (FIG. 10(*d*)) in a predetermined clock interval. In respect of each count the LSI computes ΔHF1 which is equal to the HF1 count minus the HF1 idle count accumulated at step 802.

Step 804

Each computed value ΔHF1 is compared with ΔHF1T (equal to a count corresponding to HF1T (see FIG. 10(*a*)) minus the HF1 idle count and if the ΔHF1 count is not greater than the ΔHF1T count the LSI returns to repeat step 803 in respect of the next HF1 count. If, however, the ΔHF1 count exceeds the ΔHF1T count, the LSI proceeds to step 805. It will be appreciated that step 804 is searching in effect for coin arrival. It should be noted in particular that prior to the detection of coin arrival, the electronic switches 316 and 308 are switched off because there is no power-up signal generated by the LSI on line 317 and so the LF and HF2 oscillatory circuits 302 and 301 are de-energised. Also, there is no "PROM-enable" signal generated by the LSI 316 on line 318 and so the PROM 315 is de-energised also. Therefore, the only current which is drawn from the power source is that required to maintain the HF1 oscillator on standby and to energise the LSI. This total current would typically be less than about ImA at 5 volts.

Step 805

The LSI sets the power-up latch which has the effect of generating a power-up signal on line 317 so as to supply the HF1 oscillator with full power and so as also to energise the LF and HF2 circuits. The program then proceeds simultaneously to step 806, for the HF1 signal, and to step 826, for the LF and HF2 signals.

Step 806

An HF1 timer, set to time-out a predetermined period (256 ms in this example), is started. The purpose of the HF1 timer will be explained below.

Step 807

Each successive ΔHF1 count is checked against the highest AHF1 value received since coin arrival was detected and if the current value exceeds the previously noted peak value, the current count is substituted as the new peak value.

Step 808

A determination is made as to whether each ΔHF1 count exceeds the ΔHF1T count. If so, the program proceeds to step 809 but if not (i.e. HF1 departure is detected) the program proceeds to step 810.

Step 809

If the HF1 timer is timed out, the program proceeds to step 811. Otherwise, it returns to step 808 to repeat step 808 in respect of the next ΔHF1 count. The HF1 timed period, 256 ms, is chosen such that, for all acceptable coins, HF1 departure will have been detected within the HF1 timed period. However, it is conceivable that factors such as HF1 idle drift, when the apparatus is not being used by a customer might have caused the ΔHF1 idle count to have risen above the ΔHF1T threshold. Thus the LSI would erroneously detect coin arrival and, in addition, no HF1 departure would be detected. Under such conditions, were it not for the HF1 timer the resetting of the LSI could not take place. However, in the unusual event of the HF1 idle count rising to above the HF1T threshold, after the 256 ms delay the program proceeds to step 811.

Step 811

A new HF1 idle count is stored.

Step 012

All the registers, latches, timers and sequences are reset, and the program returns to step 803 to recommence searching for arrival of another coin. Under normal circumstances, the program proceeds from step 808 directly to step 810.

Step 810:

The HF1 timer is reset.

Step 813

The peak ΔHF1 count determined in step 807 is compared with the several sets of HF1 upper and lower limit values stored in the PROM, to determine whether the peak count lies between the upper and lower limit values of one of the recognised denominations.

Step 826

Reverting to the LF and HF2 signals, the program delays for a preset period, for example 32 ms, before proceeding simultaneously to steps 814(LF) and 815(HF2). This delay allows transients in the LF and HF2 oscillations to die away before the LF and HF2 measurements are taken.

Step 814

The LF count corresponding to the number of clocked pulses counted in each cycle of the LF signal is repetitively accumulated.

Step 816

A search is made for the peak LF count of the several counts received.

Step 815

The HF2 idle count is accumulated.

Step 817

The LSI repetitively accumulates the HF2 count corresponding to the number of times the HF2 signal crosses a predetermined threshold level in a clocked interval and calculates for each HF2 count the value ΔHF2 which is equal to the HF2 count minus the HF2 idle count.

Step 818

The LSI stores the largest of the several HF2 counts as the peak count.

Step 819

The LSI searches for transition from the ΔHF2 count being greater than HF2T to the ΔHF2 count being less than ΔHF2T. If the transition condition is not satisfied the program returns to steps 816 and 818 to continue searching for peak LF and HF2 counts. When the transition condition is satisfied (i.e. HF2 departure), the program proceeds simultaneously to steps 820 and 821.

Step 820

The ΔHF2 peak count is compared with the ΔHF2 upper and lower limits for the different coin denominations read-out from the PROM to see whether the HF2 peak lies between the limit values for any one of the recognised denominations.

Step 821

The LSI accumulates the LF idle count. In this regard, it is pointed out that for the HF1 and HF2 measurements, it is necessary to accumulate the idle value before the coin has arrived in the examination region because the idle value is needed in the computations which take place when the coin is in the examination region. In the case of LF, however, it is the ratio of LF peak to LF idle which is measured and therefore the idle value can be measured before or after the coin is in the examination region. In this example, it is found to be more convenient to measure LF idle after the coin has left the examination region.

Step 822

The LSI computes the ratio of the LF peak count determined at step 816 to the LF idle count determined at step 821.

Step 823

The LSI compares the computed LF ratio with the upper and lower LF ratio limit values for the different coin denominations read out from the PROM.

Step 824

The LSI carries out a validity check to see whether the HF1, HF2 and LF tests carried out in steps 813, 820 and 823 each indicate the same denomination for the coin under test. If so, the coin is acceptable, otherwise it is not. The program then proceeds simultaneously to steps 812 and 825. Step 812 has already been described.

Step 825 The LSI outputs the result of the validity check carried out at step 824.

A very important feature of the described coin validity checking apparatus is that the use of the PROM means that the only modification which needs to be made for adapting the apparatus to the coin sets of different countries is to change the data stored in the PROM accordingly.

Referring to FIG. 9, there is shown in a time plot the change in various signals and currents in the validation circuitry. FIGS. 9(*a*) and 9(*c*) show the variation in the frequencies of the HF1 and HF2 oscillator output signals while FIG. 9(*b*) represents the amplitude of the LF oscillator output signal. FIG. 9(*d*) shows the total current drawn by the HF1 oscillator and the LSI. This current changes from an idling level, following the HF1T threshold being reached, to a higher level which lasts until shortly after the HF2 frequency falls below the HF2T threshold, after which the HF1 oscillator returns to idling again. As the damping effect of even the most attenuative coin is small at the time of sensing HF1 arrival, the idling HF1 power consumption can be very small, e.g. less than about 1 mA at 5 volts. The LF and HF2 oscillators are energised for the same time that the HF1 oscillator is operating on full power. This is shown in FIG. 9(*e*). The total current drawn by the validation circuitry during this time (apart from when the PROM is energised) is about 15 mA at 5 volts. FIG. 9(*f*) shows that the PROM is energised during a first period to enable the HF1 limit values, and during second and third periods, following HF2 departure, to enable firstly the HF2 and then the LF limit values, to be readout from the PROM. The total current drawn by the validation circuitry is relatively high at about 50–150 mA at 5 volts while the PROM is energised but the three periods during which the PROM is energised for each coin can be chosen to be just long enough for the required reading-out of limit values so as to minimise the total time for which the PROM is energised. The stated power consumption figures for the PROM apply to bipolar PROMS which are chosen for cheapness. CMOS PROMS are available with lower power consumption but currently their cost is so high as to make them unsuitable. FIG. 9(*g*) shows how the total current drawn (full line) varies with time. The dashed line indicates a typical value (below 2 mA at 5 volts) for the average current consumed. Of course, the value will depend on the mean time separating insertion of successive coins into the coin checking apparatus.

It should be noted with reference to FIG. 4, that except when a power-up signal is produced by the LSI, the outputs of the NOR gates 448,470 and 506 are held at logical "0". This renders the circuitry downstream of each gate inoperative, thereby reducing power consumption, and ensures that any spurious signals at the other inputs of these NOR gates are ineffective.

In the case of known coin checking apparatus in which all the electronic circuitry is permanently energised, the total current drawn would for example be as shown in the chain-dotted line. Clearly, therefore, the described apparatus significantly reduces the average power consumption and therefore lends itself particularly for use in applications such as pay-telephones. Also, the circuitry external to the LSI has been kept to a minimum, thereby minimising cost and increasing reliability.

By way of example each upper or lower limit value associated with each test (HF1, LF or HF2) for each recognised coin denomination is a 9 bit number which is stored in a PROM of the kind which is organised with 4 bit data words. Therefore, to read out a 9 bit number from the PROM, it is necessary to use three separate addresses for the PROM. Therefore, in this example, for a coin validity checking apparatus capable of recognising six different coin denominations, the PROM could be energised for reading out the HF1 limit values in 36 successive bursts, since each number requires three addresses and there are two limits (upper and lower) for each of the six coin denominations. The PROM could be organised so that 1 micro second is required for each reading. Therefore the total time for which the PROM would need to be energised to read out all the limit values for the three different tests would be $3\times36\times1$ microseconds equals 108 microseconds. By addressing the PROM in this way, it will be appreciated that the power consumed by the PROM on average is extremely small.

It should also be noted that the circuitry allows time periods $T_{LF}$ (FIG. 9(*b*)) and $T_{HF2}$ (FIG. 9(*c*)) between in each case switching-on the LF or HF2 oscillator and the time when the coin enters the examination region of the sensor LF or HF2. These periods allow the LF and HF2 oscillators adequate time to settle down to a constant idling frequency and amplitude after switch-on.

Reference will now be made to FIG. 10 for a fuller understanding of the significance of powering-up the HF1 oscillator. FIG. 10(*a*) corresponds to FIG. 9(*a*) and shows the variation in frequency with time of the HF1 oscillator. $t_I$ is the time at which the coin just starts to interact with the oscillating magnetic field so as to cause the frequency to increase and the signal amplitude to decrease. At time $t_{II}$, the frequency signal reaches the HF1T threshold and the HF1 oscillator is accordingly powered-up, as described above. The frequency signal reaches its maximum value at time $t_{III}$ and then falls away again to pass below the HF1T threshold. Eventually, at time $t_{IV}$, the HF1 oscillator is switched back to its idling state.

FIGS. 10(*b*) and 10(*c*) show the output oscillating signal of an oscillator which does not itself constitute an embodiment of the first and second aspects of the invention referred to above because it is continuously energised at lower (FIG. 10(*b*) and higher (FIG. 10(*c*)) levels of power, but which operates at a frequency corresponding to that of the HF1 and HF2 oscillators. It is emphasised that FIGS. 10(*b*) and (*c*), and also FIG. 10(*d*), are purely diagrammatic and that successive oscillations are shown well spaced out for purposes of illustration. In these two Figures, the envelope of the oscillating signal is denoted by dotted lines. The "+" and "−" denote the supply power rails. As already explained above, the LSI continuously assesses the instantaneous oscillator signal frequency by counting the number of times the oscillator signal crosses the voltage threshold $V_{TH}$ within a predetermined period of time. In FIG. 10(*b*) there is shown the signal waveform for an oscillator which is running at low power or idling. It will be seen that the peak signal level in the absence of a coin from the examination region is not significantly greater than the voltage threshold $V_{TH}$ so that during the tine interval T the oscillator signal is sufficiently attenuated that it is unable to cross the threshold $V_{TH}$. Therefore, during this time interval the LSI is unable to continue functioning to accumulate a count corresponding to the pulse frequency. For this reason, as indicated in FIG. 10(*c*), with known oscillators, the power is set at a sufficiently high level such that even the most heavily attenuated magnitude of the oscillator signal exceeds the threshold $V_{TH}$. Because in relatively cheap, commercially available LSIs, the switching threshold of CMOS devices used in the LSIs is given wide tolerance by manufacturers, the oscillator power has to be sufficient to ensure that even the highest of CMOS threshold voltages will be exceeded even in the case of coins giving rise to the greatest signal attenuation. With some oscillator circuit arrangements designed to satisfy this operating requirement, the power consumed when the oscillator circuit is idling can be unacceptably high for the kind of applications referred to hereinabove.

FIG. 10(*d*) clearly demonstrates how this disadvantage is overcome with an oscillator which is powered-up on coin arrival in the examination region. In this connection, it should be noted in particular with regard to FIG. 10(*b*) that, even with an oscillator running at low power, at time $t_{II}$ (coin arrival) the peaks of the oscillating signal still exceed the voltage threshold $V_{TH}$ so that the LSI can detect the coin's arrival. The HF1 oscillator therefore is designed to idle at low power in the absence of a coin. It will be seen that up to time $t_{II}$ only relatively low power is required. At this time, the HF1 oscillator is powered-up and this increases the oscillator signal magnitude to ensure that even at time $t_{II}$ it will exceed the threshold $V_{TH}$. It is only necessary that the HF1T oscillator be powered up for the time interval $T_A$, but it is more convenient to "power-down" the HF1 oscillator at the same time as the HF2 and LF oscillators are switched off, as otherwise two separate control signals would be required. For this reason, in this embodiment the HF1 oscillator remains powered-up until time $t_{IV}$.

Ideally, the threshold level HF1T should be set sufficiently low that it will be exceeded well before the coin is in a position of maximum interaction with the magnetic field. This allows the maximum period of time $T_B$ for transients to die away before the peak attenuation is reached. It should be noted, by way of example, that $T_B$ is in the order of a few milliseconds and that the HF1 oscillation frequency is of the order of 1,000 cycles/1 ms so that successive cycles are in fact very much more closely bunched than indicated in FIGS. 10(*b*) to (*d*). However, the manner shown of depicting the HF1 oscillating signal has been adopted for facilitating an understanding of these Figures.

Thus, in effect, the HF1 oscillator in its standby mode is capable merely of detecting arrival of any coin in the examination region, but it has to be powered-up to enable a sufficient oscillator amplitude to be maintained at peak attenuation in order that a quantitative evaluation of the peak frequency can be made to determine whether the coin is acceptable.

It is pointed out that the use of a sensing arrangement at a single location to both detect coin arrival and also perform a test on the coin is particularly advantageous as it avoids using an arrival sensor for sensing coin arrival and a separate measuring sensor brought into operation by the arrival sensor. Also, because the HF1 oscillator is not powered-up until the coin has arrived in the examination region of the HF1 sensor, this helps to reduce the duration for which the HF1 oscillator is powered-up and thereby "minimise" the mean power consumption of the coin validity checking apparatus.

Figure 11:
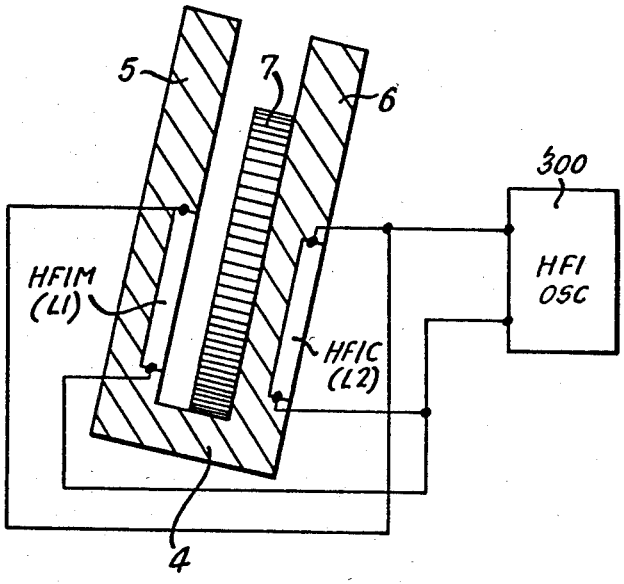
FIG. 11 shows an example of how the first inductive sensor can be connected in the oscillator circuit.

It has already been remarked in connection with FIGS. 1 and 2 that the canted arrangement of the coin track 4 is designed to ensure as far as possible that the coin remains in facial contact with the rear wall 6 by the time it rolls past the HF1, LF and HF2 sensors as otherwise side-to-side motion of the coin could produce inaccuracies in the HF1, LF and HF2 peak values which might result in an otherwise acceptable coin being rejected or a false coin being erroneously accepted. Despite the use of the canted coin track, in practice it is found that there are very slight variations in coin flight path past the sensors, particularly if, because of space limitations, the various sensors are positioned close to the energy dissipating device 3 (FIG. 1). To largely compensate for this and thereby reduce measurement scatter, both the HF1 and the LF sensors each comprise a pair of sensing coils arranged one on each side of the coin track. Referring to the FIG. 11, the HF1 sensor comprises a measuring coil HF1M mounted in far wall 5 and compensating coil HF1C mounted in the rear wall 6. In this example, the measuring and compensating coils are connected in parallel. The relative inductances (L1,L2) of the two coils is such that their effective impedance is dependent mainly on the inductance L1 of the measuring coil HF1M so that the measuring coil serves predominantly to sense the interaction between the oscillating magnetic field set up between the two coils HF1M, HF1C and the coin 7. Therefore, the inductance of the HF1M coil is substantially less than that of the HF1C coil. However, it has been found that the effect of the compensating coil is that it provides good compensation against the effect of variations in coin flight path on the output oscillating signal from the HF1 oscillator 300. However, as compared with known arrangements in which the inductances of the two coils are equal, the measurement sensitivity is significantly higher while still being highly dependent on coin thickness, with only slightly less favourable measurement scatter, so that the overall accuracy, which is largely dependent upon the ratio of sensitivity to scatter, is improved. In fact by appropriate selection of the inductance values of the two coils, the overall accuracy can be maximised. The selection depends on factors such as the length of coin track available before the sensor arrangement, the angle at which the coin track sidewalls are canted away from the vertical, and the effectiveness of any energy dissipating device at the top of coin track in changing the travelling direction of the coins with the minimum of coin bounce. To give typical examples, for very small components of lateral motion of the coins, the ratio of the inductances or capacitances of the sensing coils for maximum measurement accuracy might be typically as low as about 10%. When the side-to-side motion is more significant, it might be necessary to select the ratio at a value as high as about 90%.

In an alternative arrangement in which the two coils are connected in series, the measuring coil would then have to have an inductance which is significantly greater than that of the compensating coil, in order that the effective impedance of the two coils should be determined predominantly by the inductance of the measuring coil.

Similar considerations apply in the case of the LF sensor, except that there the LF measuring coil suitably is mounted in the rear wall 6 and the compensating coil in the front wall. The HF2 sensor is deliberately constructed from a single sensing coil, so as to avoid substantially any thickness effect. In any case, by the time the coin reaches the single HF2 coil, any variations in coil flight path and their effect can be ignored.

Figure 12:
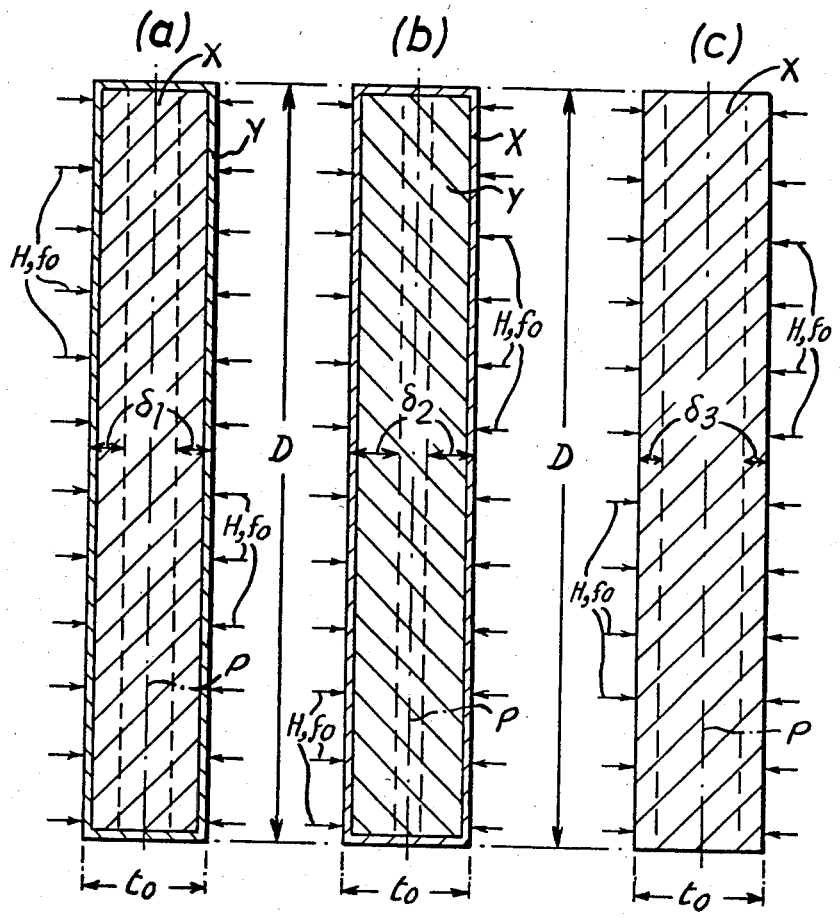
FIG. 12 shows the different "skin depths" in three coins, depicted in diametrical section, of identical diameter and thickness, resulting when each coin is subjected from both sides to an oscillating electromagnetic field of a single particular frequency, but the coins consisting of (a) a metal core clad in a different metal (b) a clad core coin with the two metals reversed and (c) a single metal only.

Reference will now be made to FIG. 12 for an appreciation of the significance of selecting the LF idle frequency as mentioned hereinabove.

In FIG. 12, there are shown three coins of identical size (diameter D) and thickness ($t_O$) which are in each case subjected from both sides by the two coils of an inductive sensor arrangement to an oscillating electromagnetic field H of frequency $f_O$, which, as mentioned above, lies in the range with upper and lower limits of substantially 80 kHz and 200 kHz. The frequency $f_O$ is preferably about 120 kHz and the LF coils are so arranged and oriented that the magnetic field is directed into the coin substantially at right angles to the faces of the coin as it passes through the examination region.

Referring to FIG. 12(*a*), the first coin consists of a core made of a metal X provided with a cladding of a different metal Y. The conductivity and magnetic permeability of the metals X and Y are such that a magnetic field will more readily penetrate metal Y than metal X. The second coin (FIG. 10(*b*)) is a clad coin having an identical cladding thickness to that of the first coin but in this case the core consists of metal Y and the cladding of metal X. In the third coin, however, (FIG. 10(*c*)), the coin is homogeous throughout, consisting of the single metal X.

The frequency $f_O$ is selected so that the skin depth within each of the three coins is below the depth of any cladding on the coin but is not as deep in the centre plane P of the coins. In the case of the first coin, the "skin depth" in the coin is denoted by $\delta_1$. For the second coin, however, the skin depth $\delta_2$ is greater than $\delta_1$ because the magnetic field can penetrate metal Y more readily than metal X. For this reason, in the case of the third coin, the skin depth $\delta_3$ is the smallest.

It will be appreciated that three different levels of peak attenuation in the LF processing circuitry will exist in respect of the three differently constituted coins shown in FIG. 12. If a significantly lower frequency were to be used such that the magnetic field would penetrate to a significant extent through all parts of the coin, and because of the "averaging" effect produced, it may be impossible to distinguish satisfactorily between the first and second coins. If on the other hand the frequency were to be very high such that owing to the "skin effect" the magnetic field were not to be able to penetrate to any significant extent below the thickness of the coin cladding, then it would not be possible to distinguish between the second and third coins. However, with appropriate choice of the LF idling frequency in the specified range, it is possible to distinguish more reliably between several different coin materials.

The LF sensor does not necessarily have to consist of two sensing coils. It could, for example, comprise a single sensing coil and this has the advantage that the LF test would then be substantially independent of coin thickness. On the other hand, there would also be no compensation for variations in coin flight path.

Finally, it is remarked that the advantages arising from the use of the specific frequency range given above for the LF sensor necessitate the use of an inductive sensing arrangement, but so far as the advantages of powering-up on coin arrival and compensating for coin flight path variations by adopting out-of-balance sensors, are concerned instead of inductive sensors, there may be employed capacitive sensors.

Various modifications to the coin validator described above are possible. Thus, for example, the LF sensor could be a one-sided coil which would be responsive primarily to coin material. With suitable design of the geometry of the flight deck of the validator, the effects of any wobble in the coin flight along the coin track past the LF sensor are minimal.

With certain circuit arrangements for the HF1 oscillator, the power consumption can be regarded as negligible, in which case no switched supply is required for the HF1 oscillator. Instead, as indicated in FIG. 13 where the same reference numerals as used in FIG. 3 denote the same or corresponding parts which need not be further described, the HF1 oscillator 300 is supplied from the positive terminal of the power source 304 and continuously draws current from the power source which passes to earth through a resistive element 306'.

Figure 13:
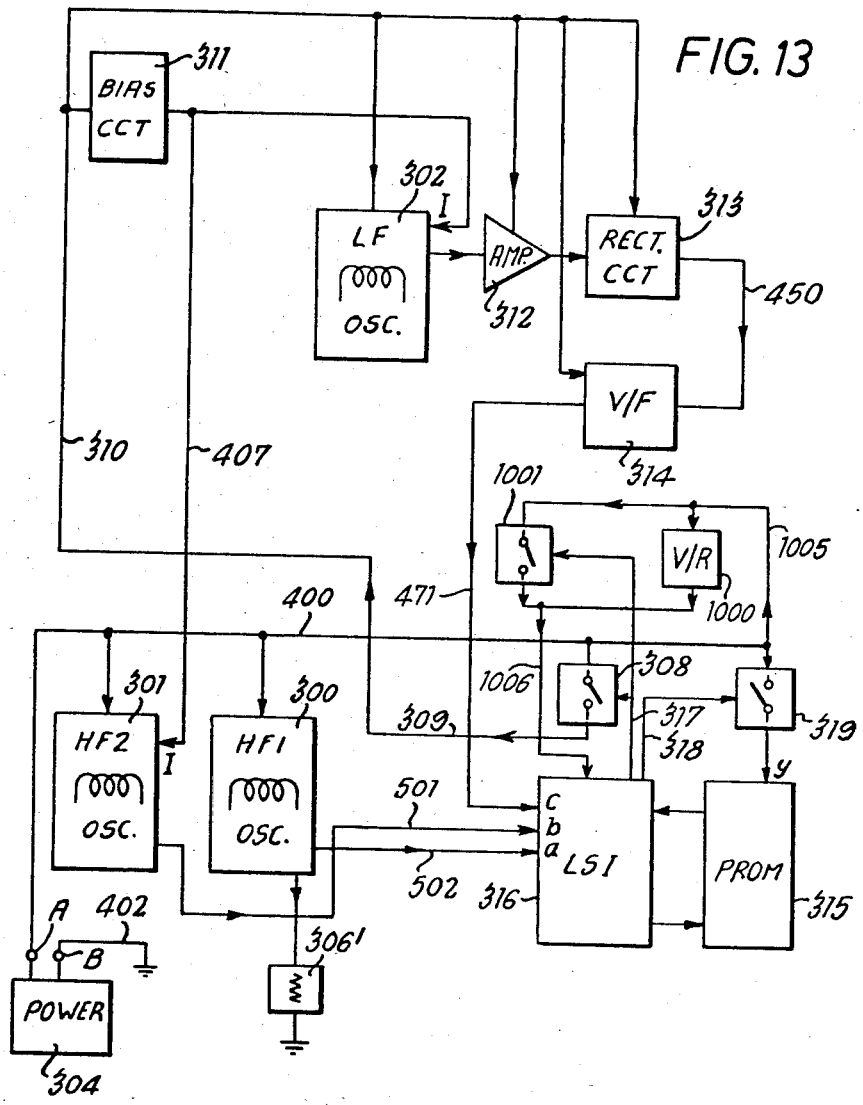
FIG. 13 is a simplified block circuit diagram, similar to FIG. 3, showing a modified discriminating and control circuit.

Another modification is incorporated into the circuit of FIG. 13. In the FIG. 3 embodiment the power consumption of the LSI, which is small, is taken to be negligible and the LSI is permanently energised. However, in some circumstances it may be desirable to reduce overall power consumption further and this can be achieved by the switched supply arrangement adopted in the circuit of FIG. 13.

As shown, a branch connection 1005 leading from supply line 400 feeds a voltage reducing device 1000 whose output is connected via line 1006 to the power supply input of the LSI 316. A normally open electronic switch 1001 is connected in parallel with the voltage reducing device 1000. The switch 1001 has a control input which is connected to line 317 to receive the power-up signal when generated by the LSI, thereby causing the switch to close.

The voltage reducing device 1000 in its simplest form comprises a high impedance resistive element. Before a coin arrives, the switch 1001 is open and a proportion of the positive potential of the power source 304, determined by the high internal resistance of the LSI, is applied to the LSI. The power supplied to the LSI in this way is sufficient to enable it to detect coin arrival.

When the power-up signal is generated on the line 317 following coin arrival, it causes the electronic switch 1001 to close so as, effectively, to short-circuit the voltage reduction device 1000 and thereby cause the positive potential of power source 304 to be applied directly to the supply input of the LSI 316 which then operates at full power to carry out the coin validity checks.

It is to be noted that the dynamic current consumption of a CMOS LSI is proportional to the square of the potential drop across it so that the total power consumed by the LSI, except during the interval during which the power-up signal is present on line 317, is significantly reduced.

Figure 14:
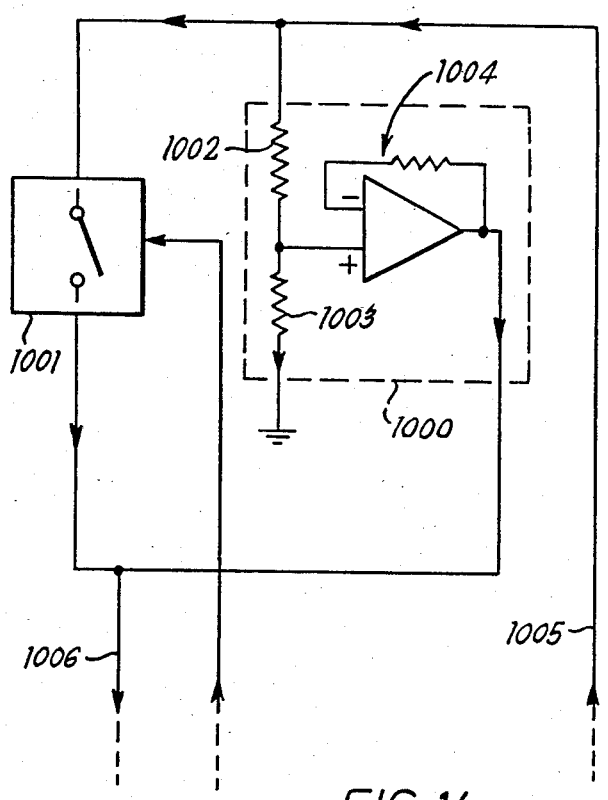
FIG. 14 is a circuit diagram of a preferred way of realising part of the circuitry of FIG. 13.

The voltage applied to the LSI prior to coin arrival needs to be sufficiently above the minimum required for the LSI to function properly in carrying but its program but at a level chosen with a view to minimising the power consumption within the LSI. In addition, depending upon the particular circuitry provided within the associated equipment (e.g. vending machine or pay telephone) to which the validator is to be connected, a minimum supply voltage is required for the LSI in order that it can function properly to output logical signals to the circuitry within the associated equipment. The value of $R_{V/R}$ is carefully chosen in order that the above criteria can be satisfied simultaneously. However, the internal resistance of the LSI can vary according to its operating state and this will cause the voltage applied to the LSI to vary too. To prevent such voltage variation, the voltage reduction device 1000 can, as shown in FIG. 14, take the form of a voltage divider, comprising resistive elements 1002, 1003, and a unity gain amplifier 1004 whose input is connected to the tapping point of the voltage divider and whose output feeds the supply input of the LSI. In this way, the supply voltage to the LSI is kept equal to the same proportion of the power source voltage as the resistance of resistive element 1003 bears to the total series resistance of elements 1002 and 1003, irrespective of any variations in $R_{LSI}$.

In the embodiments described, although the signal from sensor HF1 is used in determining whether or not a coin is acceptable, the powering-up (i.e. raising from zero or low power to full operational power) of the various circuit blocks is achieved in response to the mere occurrence in the HF1 signal of a disturbance indicative of coin arrival, irrespective of whether the signal is found appropriate for an acceptable coin. Consequently the checking apparatus can perform its automatic powering-up function in response to at least the great majority of the coin types found among the world's currencies without electrical or mechanical modification, and adaptation of the apparatus for different currencies requires only storage of the appropriate limit values in the PROM.

Also, the arrival of every item which might be a genuine coin is sensed, and not only those items which pass an initial test designed to discriminate between acceptable and non-acceptable coin types. Thus, without adding components beyond those required for the coin checking function, signals are made available which enable the number of coins not accepted, as well as the number accepted, to be monitored. This can serve as a guide for assessing whether a particular apparatus is being fed with an unusual number of slugs, or non-genuine coins and/or is not functioning correctly.

We claim:

1. Apparatus for checking the validity of coins, the apparatus requiring electrical power for its coin checking operation, comprising means defining a coin path, and a first interacting means for interacting with a coin on the coin path to provide an information signal in response to at least the great majority of coin types, characterized by a circuit means which is connected to the first interacting means, and which evaluates the information signal, the circuit means including a coin detector portion and a coin validity checking portion, the coin detector portion detecting whether the information signal is indicative of the presence of a coin on the coin path in the vicinity of the interacting means, and if coin presence is detected, enabling the coin validity checking portion to determine if the information signal is indicative of an acceptable coin by initiating the application within the apparatus of power adequate for checking the validity of coins, the coin validity checking portion including a plurality of circuit sections which are adapted to be individually powered-up, and control means arranged to power-up each of said circuit sections through periods when its operation is required for coin checking purposes but not through other periods.

2. Apparatus as claimed in claim 1, wherein one of said circuit sections is a memory section which contains reference values associated with acceptable coins and the control means is adapted to power-up the memory section through periods when access to its contents is required but not through other periods.

3. Apparatus as claimed in claim 1 wherein the control means is adapted to respond to the occurrence of said information signal by increasing the power applied to itself during a coin checking operation.

4. Apparatus as claimed in claim 1, characterized in that in the absence of a coin said first interacting means is operable at a low power level and said control means is responsive to occurrence of said information signal to power-up said interaction means to a higher power level throughout a subsequent portion of said information signal.

5. Apparatus as claimed in claim 4, characterised by a plurality of additional interaction means which are normally not powered, wherein said control means powers up all said additional interaction means in response to said information signal occurring.

6. Apparatus as claimed in claim 1, characterized by a plurality of additional interaction means, said first interaction means being adapted to operate at a continuous power level, and the control means being adapted to power-up the additonal interaction means in response to the occurrence of said information signal.

7. Apparatus according to claim 4, characterised in that the coin validity portion for determining whether the information signal is indicative of an acceptable coin requires the information signal to maintain at least a predetermined amplitude that the information signal decreases in amplitude in response the first interacting means interacting with a coin, that at low power the decreased amplitude of the information signal is less than said predetermined amplitude, and that the first interacting means is powered-up such that the decreased amplitude of the information signal remains above the predetermined amplitude.

8. Apparatus as claimed in claim 1 characterized by a common coin path for all coins to be inserted in the apparatus.

9. Apparatus as claimed in claim 1, 3, 4, 5, 6, 7, or 8, wherein the coin validity checking portion includes a memory containing reference values associated with acceptable coins, the coin validity checking portion being operative to compare the information signals with said reference values to determine whether or not a coin being checked is an acceptable coin, said memory being programmable with any desired set of reference values corresponding with any desired set of coins to be found acceptable.

10. Apparatus as claimed in claim 1, wherein the interaction means comprises a pair of inductive sensing devices which are mounted generally opposite, and spaced away from, one another on opposite sides, respectively, of the coin path which is so arranged that a coin travelling along the coin path will remain substantially in a predetermined lateral positional relationship relative to the sensing devices as it passes between them, the sensing devices being connected in circuit with the coin validity checking portion such that one of them is a measuring device which serves predominantly for detecting one or more characteristics of the coin dependent upon the degree of interaction between the field and the coin while the other one is a compensating device which serves predominantly to reduce measurement scatter due to variations in coin flight path, the inductance values of the sensing devices being selected at different values so as to increase the ratio of measurement sensitivity to scatter.

11. Apparatus as claimed in claim 10, wherein the sensing devices are inductances connected together in series, the measuring inductance having a larger inductance value than the compensating inductance.

12. Apparatus as claimed in claim 10, wherein the sensing devices are inductances connected together in parallel, the measuring inductance having a smaller inductance value than the compensating inductance.

13. Apparatus as claimed in claim 1, characterised in that the interaction means is an inductive sensor arranged to subject a coin in the examination region to an oscillating electromagnetic field and said coin validity checking portion is arranged to determine whether the degree of interaction between the field and the coin is indicative of an acceptable coin, the field being oriented so as to penetrate the coin in a direction substantially normal to its faces and the frequency of the oscillating field being such that in the presence of an acceptable coin which has a surface cladding, the skin depth of the field within the coin is below the depth of the surface cladding but not as deep as the central plane of the coin.

14. Apparatus as claimed in claim 1, characterised in that the information signal is provided in the form of an oscillating signal and converted to a d.c. signal, wherein the conversion is effected by a rectifying circuit which comprises first and second circuit networks, means to present the positive and negative half-cycles of the oscillating signal alternately to the two networks, a smoothing device in each network to convert the respective halfwave signal into a d.c. signal, and means to combine the d.c. signal from the two networks so as to produce an output signal whose magnitude is equal to the sum of the moduli of the two d.c. signals.

15. Apparatus as claimed in claim 1, wherein the interaction means comprises a pair of capacitive sensing devices which are mounted generally opposite, and spaced away from, one another on opposite sides, respectively, of the coin path which is so arranged that a coin travelling along the coin path will remain substantially in a predetermined lateral positional relationship relative to the sensing devices as it passes between them, the sensing devices being connected in circuit with the coin validity checking portion such that one of them is a measuring device which serves predominantly for detecting one or more characteristics of the coin dependent upon the degree of interaction between the field and the coin while the other one is a compensating device which serves predominantly to reduce measurement scatter due to variations in coin flight path, the capacitance values of the sensing devices being selected at different values so as to increase the ratio of measurement sensitivity to scatter.

16. Apparatus for checking the validity of coins, the apparatus requiring electrical power for its coin checking operation, and comprising circuitry arranged to establish a changing magnetic field in an examination region, and to determine whether the degree of interaction between a coin, when in the examination region, and the field is indicative of an acceptable coin, said circuitry including electrical circuit sections which are adapted to be individually powered-up; means for sensing the arrival of a coin for checking; and control means arranged to power-up, in response to the sensing means sensing coin arrival, each of said circuit sections through periods when its operation is required for a coin checking operation, but not through other periods.

17. Apparatus for checking the validity of coins, comprising an electrically operated sensor for interacting with a coin to be checked and producing an information signal in response to said interaction, said sensor being operable in a coin arrival sensing mode and in a coin checking mode, the apparatus comprising means for applying electrical power to said sensor at a low level so as to operate the sensor in said coin arrival sensing mode, said low level being sufficient for said information signal to be produced to a detectable degree during an initial period of said interaction, and control means for detecting the occurrence of said information signal as an indicator of arrival of a coin at said sensor and in response increasing the power applied to said sensor and thus increasing the information signal, so as to operate the sensor in said coin checking mode.

18. Apparatus as claimed in claim 17, including electrical circuit sections which are adapted to be individually powered-up for checking the validity of coins, and said control means being arranged to power-up, in response to detecting coin arrival, each of said circuit sections through periods when its operation is required for a coin checking operation, but not through other periods.

19. Apparatus as claimed in claim 18, comprising a memory circuit section which contains reference values associated with acceptable coins and the control means is adapted to power-up the memory section through periods when access to its contents is required but not through other periods.

20. Apparatus as claimed in claim 18 or claim 19, wherein the control means is adapted to respond to detection of coin arrival by increasing the power applied to itself during a coin checking operation.

21. Apparatus as claimed in claim 18, wherein said sensor is one of a plurality of sensors each adapted to interact with the coin to produce an information signal dependent on a characteristic of the coin, the plurality of sensors with the exception of said sensor normally not being powered, wherein said control means powers up all said sensor means in response to the sensing of coin arrival.

22. Apparatus according to claim 17, comprising means for determining whether the information signal from said sensor at its operating power level is indicative of an acceptable coin, wherein said circuit means requires said information signal to maintain at least a predetermined amplitude, wherein said information signal decreases in amplitude in response to said sensor interacting with a coin, wherein at low power the decreased amplitude of this information signal would be less than said predetermined amplitude and wherein said sensor is powered-up such that the decreased amplitude of said information signal remains above the predetermined amplitude.

23. Apparatus as claimed in claim 17, further comprising a common coin path for all coins to be inserted in the apparatus.

24. Apparatus as claimed in claim 21 comprising circuit means which includes said memory section containing reference values associated with acceptable coins, the circuit means being operative to compare said information signals with said reference values to determine whether or not a coin being checked is an acceptable coin, said memory being programmable with any desired set of reference values corresponding with any desired set of coins to be found acceptable.

25. Apparatus as claimed in claim 17, wherein said sensor for interacting with a coin comprises a pair of inductive sensing devices which are mounted generally opposite, and spaced away from, one another on opposite sides, respectively, of the coin path which is so arranged that a coin travelling along the path will remain substantially in a predetermined lateral positional relationship relative to the sensing devices as it passes between them, the sensing devices being connected in circuit with said circuit means such that one of them is a measuring device which serves predominantly for detecting one or more characteristics of the coin dependent upon the degree of interaction between the field and the coin while the other one is a compensating device which serves predominantly to reduce measurement scatter due to variations in coin flight path, the inductance values of each of the sensing devices being selected so as to increase the ratio of measurement sensitivity to scatter.

26. Apparatus as claimed in claim 25, wherein the sensing devices are inductances connected together in series, the measuring inductance having the larger inductance value.

27. Apparatus as claimed in claim 26, wherein the sensing devices are inductances connected together in parallel wherein the measuring inductance has the smaller value.

28. Apparatus as claimed in claim 17, wherein said sensor for interacting with a coin is an inductive sensor arranged to subject a coin in the examination region to an oscillating electromagnetic field, and including circuit means arranged to determine whether the degree of interaction between the field and the coin is indicative of an acceptable coin, the field being oriented so as to penetrate the coin in a direction substantially normal to its faces and the frequency of the oscillating field being such that in the presence of an acceptable coin which has a surface cladding the skin depth of the field within the coin is below the depth of the surface cladding but not as deep as the central plane of the coin.

29. Apparatus as claimed in claim 21 or 24 wherein at least one of said information signals is provided in the form of an oscillating signal and converted to a d.c. signal, wherein the conversion is effected by a rectifying circuit which comprises first and second circuit networks, means to present the positive and negative half-cycles of the oscillating signal alternately to the two networks, a smoothing device in each network to convert the respective half-wave signal into a d.c. signal, and means to combine the d.c. signals from the two networks so as to produce an output signal whose magnitude is equal to rhe sum of the moduli of the two d.c. signals.

30. Apparatus as claimed in claim 18, further comprising means defining a coin path, at least one means for interacting with a coin on the coin path to provide an information signal, one of said interacting means being said sensor and providing its information signal in response to a least the great majority of coin types, circuit means for determining whether the information signals are indicative of an acceptable coin, and said control means being operable by the occurrence of the information signal from said sensor to initiate said powering-up of the circuit sections, the control means being adapted to so operate irrespective of whether or not the information signal from said sensor is indicative of an acceptable coin, whereby said powering-up occurs substantially every time a coin passes along the coin path.

31. Apparatus as claimed in claim 17, wherein said sensor for interacting with a coin comprises a pair of capacitive sensing device which are mounted generally opposite, and spaced away from, one another on opposite sides, respectively, of the coin path which is so arranged that a coin travelling along the path will remain substantially in a predetermined lateral positioned relationship relative to the sensing device as it passes between them, the sensing devices being connected in circuit with said circuit means such that one of them is a measuring device which serves predominantly for detecting one or more characteristics of the coin dependent upon the degree of interaction between the field and the coin while the other one is a compensating device which serves predominantly to reduce measurement scatter due to variations in coin flight path, the capacitance values of each of the sensing devices being selected so as to increase the ratio of measurement sensitivity to scatter.

32. Apparatus for checking the validity of coins, the apparatus requiring electrical power for its coin checking operation, and comprising circuitry arranged to establish a changing electric field in an examination region, and to determine whether the degree of interaction between a coin, when in the examination region, and the field is indicative or an acceptable coin, said circuitry including electrical circuit sections which are adapted to be individually powered-up; means for sensing the arrival of a coin for checking; and control means arranged to power-up, in response to the sensing means sensing coin arrival, each of said circuit sections through periods when its operation is required for a coin checking operation, but not through other periods.

* * * * *

UNITED STATES PATENT AND TRADEMARK OFFICE

CERTIFICATE OF CORRECTION

PATENT NO. : 4,601,380

DATED : July 22, 1986

INVENTOR(S) : Dean et al.

It is certified that error appears in the above-identified patent and that said Letters Patent is hereby corrected as shown below:

Col. 26, line 63, change "but" to --out--.

Col. 28, claim 7, line 36, after "response" insert --to--.

Col. 29, claim 14, line 37, change "signal" to --signals--.

Col. 32, claim 29, line 2, change "rhe" to --the--.

Col. 32, claim 31, lines 21 and 27, change "device" to --devices--.

Col. 32, claim 32, line 45, change "or" to --of--.

Signed and Sealed this

Fourth Day of September, 1990

*Attest:*

HARRY F. MANBECK, JR.

*Attesting Officer*

*Commissioner of Patents and Trademarks*